US007022419B2

(12) United States Patent
Ishigami et al.

(10) Patent No.: US 7,022,419 B2
(45) Date of Patent: Apr. 4, 2006

(54) COMPOSITE PLATING FILM AND A PROCESS FOR FORMING THE SAME

(75) Inventors: Osamu Ishigami, Sayama (JP); Tomohiro Hirata, Sayama (JP); Yoshimitsu Ogawa, Sayama (JP); Nobuhiko Yoshimoto, Sayama (JP)

(73) Assignee: Honda Giken Kogyo Kabushiki Kaisha, Minato-ku (JP)

( * ) Notice: Subject to any disclaimer, the term of this patent is extended or adjusted under 35 U.S.C. 154(b) by 78 days.

(21) Appl. No.: 10/472,635

(22) PCT Filed: Dec. 12, 2001

(86) PCT No.: PCT/JP01/10894

§ 371 (c)(1),
(2), (4) Date: Mar. 24, 2004

(87) PCT Pub. No.: WO02/50342

PCT Pub. Date: Jun. 27, 2002

(65) Prior Publication Data

US 2004/0211672 A1 Oct. 28, 2004

(30) Foreign Application Priority Data

Dec. 20, 2000 (JP) ..... 2000-387480
Dec. 20, 2000 (JP) ..... 2000-387627
Dec. 28, 2000 (JP) ..... 2000-403396
Dec. 28, 2000 (JP) ..... 2000-403410

(51) Int. Cl.
*B32B 15/20* (2006.01)

(52) U.S. Cl. ..... 428/635; 428/675; 428/687; 428/935; 205/109; 123/668

(58) Field of Classification Search ..... None
See application file for complete search history.

(56) References Cited

U.S. PATENT DOCUMENTS 1,379,089 A * 5/1921 Edison ..... 205/148
1,397,785 A * 11/1921 Rose, Jr. ..... 428/635
2,425,022 A * 8/1947 Bart ..... 359/883
2,428,033 A * 9/1947 Nachtman ..... 205/138
3,217,750 A * 11/1965 Thomas ..... 138/41
3,583,290 A * 6/1971 Briggs et al. ..... 92/158
4,511,438 A * 4/1985 DiStefano et al. ..... 428/586
4,659,436 A * 4/1987 Kaylor ..... 428/634
6,478,931 B1 * 11/2002 Wadley et al. ..... 204/192.12
2001/0050179 A1 * 12/2001 Meltzer et al. ..... 174/250

(Continued)

FOREIGN PATENT DOCUMENTS

DE 2124637 * 12/1971

(Continued)

OTHER PUBLICATIONS

Chemical Abstract for SU 476330, Nov. 4, 1975, 1 page.*

(Continued)

*Primary Examiner*—John J. Zimmerman
(74) *Attorney, Agent, or Firm*—Hamre, Schumann, Mueller & Larson, P.C.

(57) ABSTRACT

A composite nickel and copper alloy plating film (3) containing nickel and copper. Nickel is of high wear resistance and a nickel alloy improves the wear resistance of the film. Copper is of high resistance of the film. The film may further contain self-lubricating particles and hard particles which ensure its wear resistance and lubricating property to a further extent.

19 Claims, 15 Drawing Sheets

U.S. PATENT DOCUMENTS

2002/0071962 A1* 6/2002 Schreiber et al. ..... 428/635

FOREIGN PATENT DOCUMENTS

| | | | |
|---|---|---|---|
| DE | 2909744 | * | 9/1980 |
| JP | 48-73340 | * | 7/1978 |
| JP | 60-2697 | * | 1/1985 |
| JP | 60247468 | | 7/1985 |
| JP | 5195117 | | 3/1993 |
| JP | 2001-158996 | * | 6/2001 |

OTHER PUBLICATIONS

Chemical Abstract for SU 635156, Nov. 30, 1978, 1 page.*
Chemical Abstract for SU 889176, Dec. 17, 1981, 1 page.*
Fawzy M H et al: "Effect of Some Operating Variables on the Characteristics of Electrodeposited Cu-Ni Alloys with and without Alpha-Al203 and Ti02inert Particles" Journal of Chemical Technology and Biotechnology. (International Journal of Biotechnical and Chemical Processes), Elsevier Applied Science Publishers. Barking, GB, vol. 66, No. 2, (Jun. 1, 1996), pp. 121-130,XP000625186 ISSN: 0268-2575.
Fawzy M H et al: "Effect of Superimposed Sinusoidal A.C. on the Characteristics of Electrodesposited Ni, Cu and Cu-Ni Alloy Composites with Alpha-Al203and Ti02" Transactions of the Institute of Metal Finishing, Institute of Metal Finishing. London, GB, vol. 76, Part 5, (Sep. 1, 1998), pp. 193-202, XP000777662 ISSN: 0020-2967.

* cited by examiner (COMPARATIVE EXAMPLE)

(PRESENT EMBODIMENNTT)

(COMPARATIVE EXAMPLE)

(PRESENT EMBODIMENT)

COMPOSITE PLATING FILM AND A PROCESS FOR FORMING THE SAME

PRIORITY

This application is a National Stage filing under 35 USC 371 of PCT/JP01/10894 filed on Dec. 12, 2001.

TECHNICAL FIELD

This invention relates to a composite plating film formed from nickel and copper alloys.

BACKGROUND ART

There has been known a cylinder block made by die casting for an automobile internal combustion engine and defining inner wall surfaces for cylinders. The block has a nickel (Ni) plating film formed on the inner wall surface of each cylinder for maintaining its hardness, sliding property and wear resistance.

Fuel (gasoline) contains a very small amount of sulfur as impurity, and if sulfuric acid is formed by such sulfur in a cylinder, it is likely to corrode the nickel plating film on the inner wall surface of the cylinder. This makes it difficult to raise the durability of any such cylinder block. Accordingly, it is desirable to raise the resistance of any such film to corrosion by sulfuric acid and thereby the durability of the cylinder block.

When an internal combustion engine is in operation, engine oil serves as a lubricant to prevent any seizure from occurring between the piston rings and the inner wall surfaces of the cylinders. If the engine is stopped, engine oil drops off the inner wall surfaces of the cylinders and collects in an oil pan and a crankcase. When the engine is started again, therefore, there remains too small an amount of engine oil adhering to the pistons and the cylinder wall surfaces to ensure any satisfactory lubrication thereof. As a result, seizure is likely to occur when the engine is started again.

DISCLOSURE OF THE INVENTION

The present invention provides a composite plating film formed from nickel and copper alloys and improved in corrosion resistance and lubricating property, as well as a process for forming the same.

As a result of our tests conducted to ascertain the resistance of a plating film to corrosion by sulfuric acid, we, the inventors of this invention, have found that the addition of copper (Cu) having a high corrosion resistance to nickel (Ni) makes it possible to form a plating film having an improved resistance to corrosion by sulfuric acid. The plating film on the inner wall surface of a cylinder is required to be highly resistant to wear by a piston ring sliding thereon. It is also required to be highly lubricant to prevent any seizure caused by insufficient lubrication when the engine is started. Under these circumstances, we have found that the addition of a controlled amount of copper to nickel and the addition of self-lubricating, or hard particles to a plating film make it possible to ensure its wear resistance and lubricating property.

According to a first aspect of this invention, there is provided a composite plating film covering the surface of a base material and composed of nickel and copper alloys.

Desirably, the film is composed of a nickel alloy layer containing less than 50% of copper with nickel and a copper alloy layer containing less than 50% of nickel with copper. It is desired that the nickel and copper alloy layers are laid alternately, while the film has a roughened surface having a roughness of 1 to 3 microns as indicated by its maximum height (Rmax), so that the nickel and copper alloys may be exposed substantially uniformly in the film surface.

Nickel is of high wear resistance and a nickel alloy makes a plating film of high wear resistance. Copper is of high corrosion resistance and a copper alloy makes a plating film of high corrosion resistance. Accordingly, the substantially uniform exposure of nickel and copper alloys in the surface of a plating film improves both of its wear and corrosion resistances.

If the film has a surface roughness of only less than one micron (Rmax), its nickel alloy layer is not cut satisfactorily to expose the copper alloy layer as desired. If it has a surface layer of at least one micron (Rmax), the copper alloy layer is exposed satisfactorily. No surface roughness over three microns (Rmax) is, however, desirable to ensure the flatness of the film.

Preferably, the film contains self-lubricating particles and hard particles. These particles improve the lubricating property and wear resistance of the film. The self-lubricating particles may be of at least one of, for example, C, h-BN and $MoS_2$. The particles of C, h-BN or $MOS_2$ are a solid lubricant having a hexagonal crystal structure, and give a high level of lubrication even where no lubricant oil is available. The hard particles may be of at least one of, for example, SiC, $Si_3N_4$, $Al_2O_3$, c-BN and diamond. The particles of SiC, $Si_3N_4$, $Al_2O_3$, c-BN or diamond have a Vickers hardness (Hv) of 3,000 or above and give a satisfactorily improved wear resistance to the film.

The film may comprise self-lubricating particles, hard particles and 10 to 50 atm. % of copper, the balance being nickel. If its copper content is lower than 10 atm. %, the film has an undesirably low corrosion resistance. If its copper content exceeds 50 atm. %, the film has an undesirably low wear resistance.

The film contains 2 to 15% by volume of each of self-lubricating and hard particles. If the proportion of the self-lubricating particles is lower than 2% by volume, the film is unsatisfactory in lubrication and seizure is likely to occur, for example, between a cylinder and a piston of an engine. If the proportion exceeds 15% by volume, a higher electric current is required and results in a lower plating efficiency. If the proportion of the hard particles is lower than 2% by volume, the film is unsatisfactorily low in hardness and wear resistance. If the proportion exceeds 15% by volume, a higher electric current is required and results in a lower plating efficiency.

The film is suitable as a coating on, for example, the inner wall surface of any cylinder in an internal combustion engine. It is so high in corrosion resistance as to protect the inner wall surface of the cylinder from corrosion by sulfuric acid, and is also so high in wear resistance as to protect the inner wall surface of the cylinder from wear. It is also high in lubricating property and prevents any seizure from occurring on the inner wall surface of the cylinder when the engine is started.

According to a second aspect of this invention, there is provided a process for forming a composite plating film of nickel and copper alloys on the surface of a base material, which process comprises the steps of preparing a coating solution containing nickel, copper, self-lubricating particles, hard particles, a cationic surface active agent and sodium saccharate as a hardness raising agent, and applying an electric current to the solution and the base material.

If a pulsed current is employed, nickel and copper alloy layers are formed alternately to form the film on the base material. The film has its surface roughened to have the nickel and copper alloys exposed substantially uniformly in its surface.

The self-lubricating particles are preferably of at least one of C, h-BN and $MOS_2$ to ensure the formation of a film of high lubricating property. The hard particles are preferably of at least one of SiC, $Si_3N_4$, $Al_2O_3$, c-BN and diamond to ensure the high wear resistance of the film. The cationic surface active agent activates the self-lubricating particles so that an improved composition efficiency may be obtained. The sodium saccharate strains and finely divides the crystals of the materials in the film and thereby improves its hardness.

The process may be carried out such that the film contains the self-lubricating particles in the amount of $6\times10^{-5}$ to $4.2\times10^{-3}$ mol/cm$^3$. If their amount is smaller than $6\times10^{-5}$ mol/cm$^3$, the film is too low in lubricating property to ensure that no seizure be likely to occur. If their amount exceeds $4.2\times10^{-3}$ mol/cm$^3$, a higher electrical resistance brings about a lower plating efficiency.

The process may also be carried out such that the film contains the hard particles in the amount of $7\times10^{-5}$ to $5\times10^{-3}$ mol/cm$^3$. If their amount is smaller than $7\times10^{-5}$ mol/cm$^3$, the film is so low in hardness as to get easily worn and be low in durability. If their amount exceeds $5\times10^{-3}$ mol/cm$^3$ a higher electrical resistance brings about a lower plating efficiency.

The process may also be carried out such that the film contains the surface active agent in the amount of $5\times10^{-3}$ to $1\times10^{-1}$ mol/cm$^3$. If its amount is smaller than $5\times10^{-3}$ mol/cm$^3$ it may fail to activate the self-lubricating particles for an improved lubrication and thereby an improved composition efficiency. If its amount exceeds $1\times10^{-1}$ mol/cm$^3$, a higher electrical resistance brings about a lower plating efficiency.

The process may also be carried out such that the film contains the hardness raising agent in the amount of $5\times10^{-6}$ to $3\times10^{-5}$ mol/cm$^3$. If its amount is smaller than $5\times10^{-6}$ mol/cm$^3$ it may fail to strain or finely divide the crystals and thereby improve the hardness of the film. If its amount exceeds $3\times10^{-5}$ mol/cm$^3$ a higher electrical resistance brings about a lower plating efficiency.

The coating solution may further contain citric acid, and the step of applying an electric current may be the step of applying a constant current citric acid serves as a complex-forming agent and enables copper to be thoroughly dissolved in the coating solution, so that copper may be thoroughly precipitated without settling.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Description will now be made in detail of several preferred embodiments of this invention with reference to the accompanying drawings.

Figure 1:
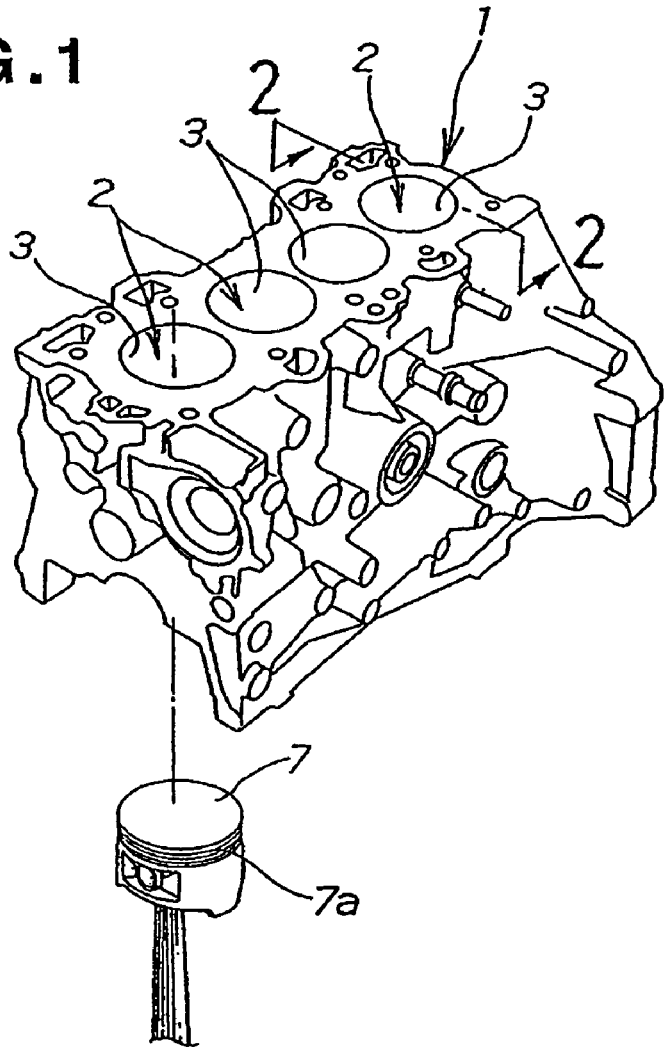
FIG. 1 is a perspective view of a cylinder block for an internal combustion engine having a plating film of nickel and copper alloys formed thereon according to this invention.

FIG. 1 shows a cylinder block for an internal combustion engine (hereinafter referred to merely as cylinder block) as an example of base materials. The cylinder block 1 is a cylinder block of an aluminum alloy for a four-cylinder engine having a composite plating film 3 of nickel and copper alloys formed on the inner wall surface 2*a* (FIG. 2) of a cylinder defined by each cavity 2 in which a piston 7 is slidable. A piston ring 7*a* is formed from stainless steel (SUS) and has a surface hardened by e.g. gas nitriding. The film 3 comprises a nickel and copper alloy matrix 4 formed by an alternate array of a nickel alloy layer 4*a* composed of nickel and less than 50% of copper and a copper alloy layer 4*b* composed of copper and less than 50% of nickel, and has a surface roughened to a roughness of one to three microns by maximum height (Rmax), so that its nickel and copper alloy layers 4*a* and 4*b* may be exposed substantially uniformly in its surface. The matrix 4 further contains self-lubricating particles 5 and hard particles 6. The properties of the film 3 will be described in detail with reference to FIG. 11 later.

Figure 3:
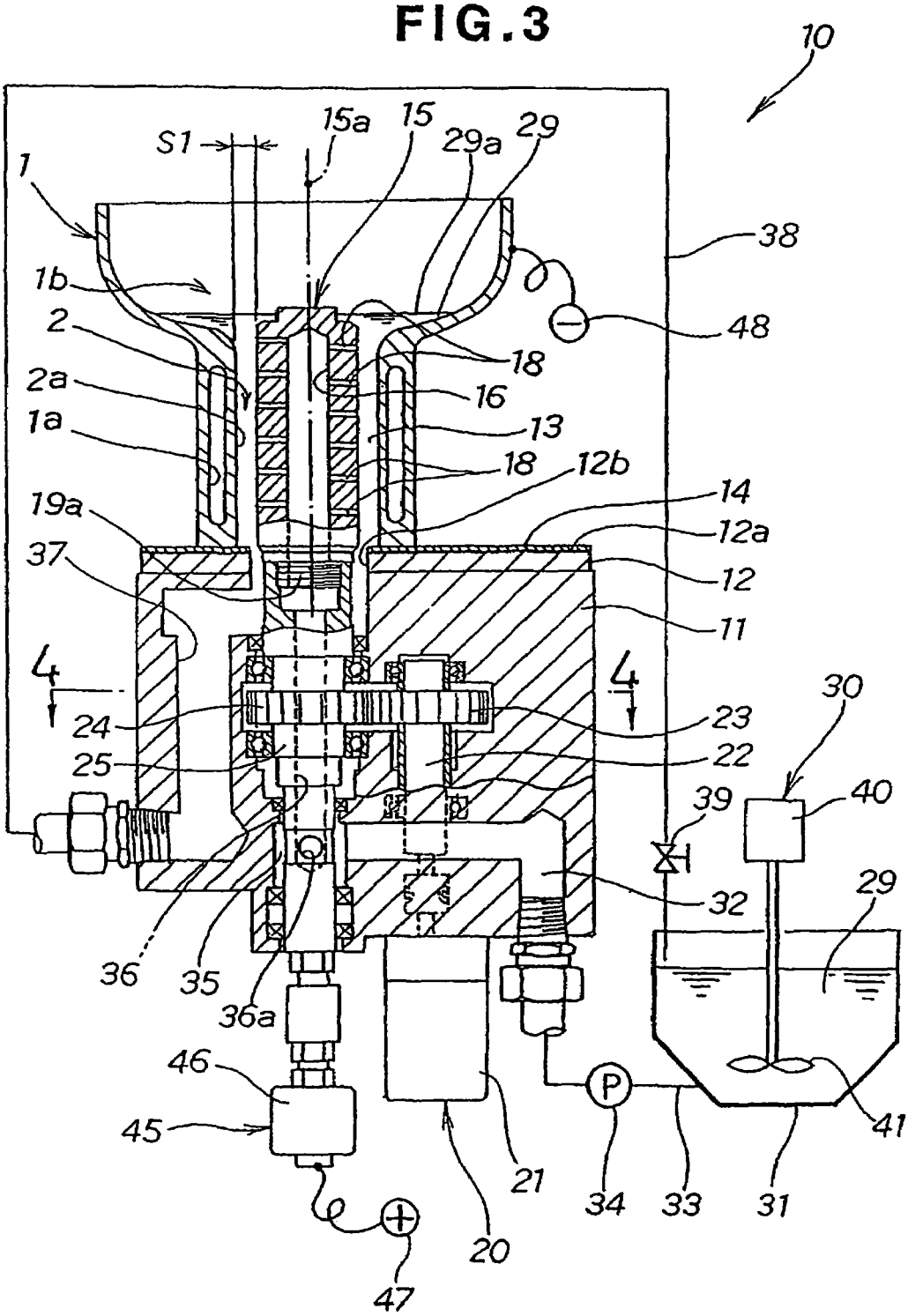
FIG. 3 is a view illustrating an overall arrangement of a composite plating apparatus used for forming the film shown in FIG. 2.

Reference is now made to FIGS. 3 to 6 showing a composite plating apparatus for forming the film 3 on the cylinder block 1. Referring to FIG. 3, the apparatus 10 comprises a main body 11, a work table 12 attached to the main body 11 for mounting a cylinder block 1 thereon, a cylindrical electrode 15 positioned in each cavity 2 of the cylinder block 1 mounted on the work table 12, a mechanism 20 for rotating the cylindrical electrode 15 about its longitudinal axis 15*a*, a mechanism 30 for circulating a composite nickel and copper alloy plating solution 29 into the bore 16 of the cylindrical electrode 15, and a mechanism 45 for supplying an electric current to the cylinder block 1 and the cylindrical electrode 15. Details of the cylindrical electrode 15 will be described with reference to FIGS. 5 and 6. The cylinder block 1 also has a cooling water jacket 1*a*, a crank chamber 1*b* and an annular passage 13 defined by a clearance S1 between the inner wall surface 2*a* of a cylinder and the cylindrical electrode 15.

The work table 12 has a work supporting surface 12*a* covered with an insulating member 14 and a hole 12*b* for collecting the plating solution 29. The insulating member 14 may be a sheet of e.g. a ceramic material, or synthetic resin. The insulating member 14 isolates the work table 12 from the cylinder block 1, so that no electric current may be supplied to the work table 12. The hole 12*b* collects the plating solution 29 after its impingement upon the inner wall surface 2*a* of the cylinder and thereby ensures its smooth circulation.

The rotating mechanism 20 is intended for rotating four cylindrical electrodes 15 if the cylinder block is for a four-cylinder engine, but the following description will refer merely to the rotation of a single electrode 15. The rotating mechanism 20 comprises a motor 21 attached to the main body 11, a drive shaft 22 connected to the motor 21, a drive gear 23 attached to the drive shaft 22, a gear 24 meshing with the drive gear 23 and a rotating shaft 25 having a middle portion to which the gear 24 is attached, and an upper end in which the cylindrical electrode 15 has its threaded portion 19*a* connected. As regards the mechanism for rotating the four cylindrical electrodes 15, description will be made in detail with reference to FIG. 4 later.

The solution circulating mechanism 30 comprises a tank 31 for storing the plating solution 29, a first supply passage 33 extending from the tank 31 to a supply port 32, a pump 34 installed in the first supply passage 33, a chamber 35 formed at the outlet of the supply port 32, a second supply passage 36 formed in the rotating shaft 25 and having an inlet 36*a* connected with the chamber 35, the bore 16 of the cylindrical electrode 15 being connected with the outlet of the second supply passage 36, the electrode having a plurality of through holes 18 through which its bore 16 is connected with the annular passage 13, a collecting port 37 connected with the annular passage 13 through the collecting hole 12*b* of the work table 12, a collecting passage 38 extending from the collecting port 37 to the tank 31, a control valve 39 installed in the collecting passage 38 and a stirrer 40 attached to the tank 31. The control valve 39 is used for controlling the level 29*a* of the solution 29 in the crank chamber 1*b*. The stirrer 40 has an impeller 41 for stirring the solution 29 in the tank 31.

The electric current supplying mechanism 45 includes a rotary connector 46 attached to the lower end of the rotating shaft 25 for supplying an electric current thereto, a positive electrode 47 connected to the rotary connector 46 and a negative electrode 48 connected to the cylinder block 1.

Figure 4:
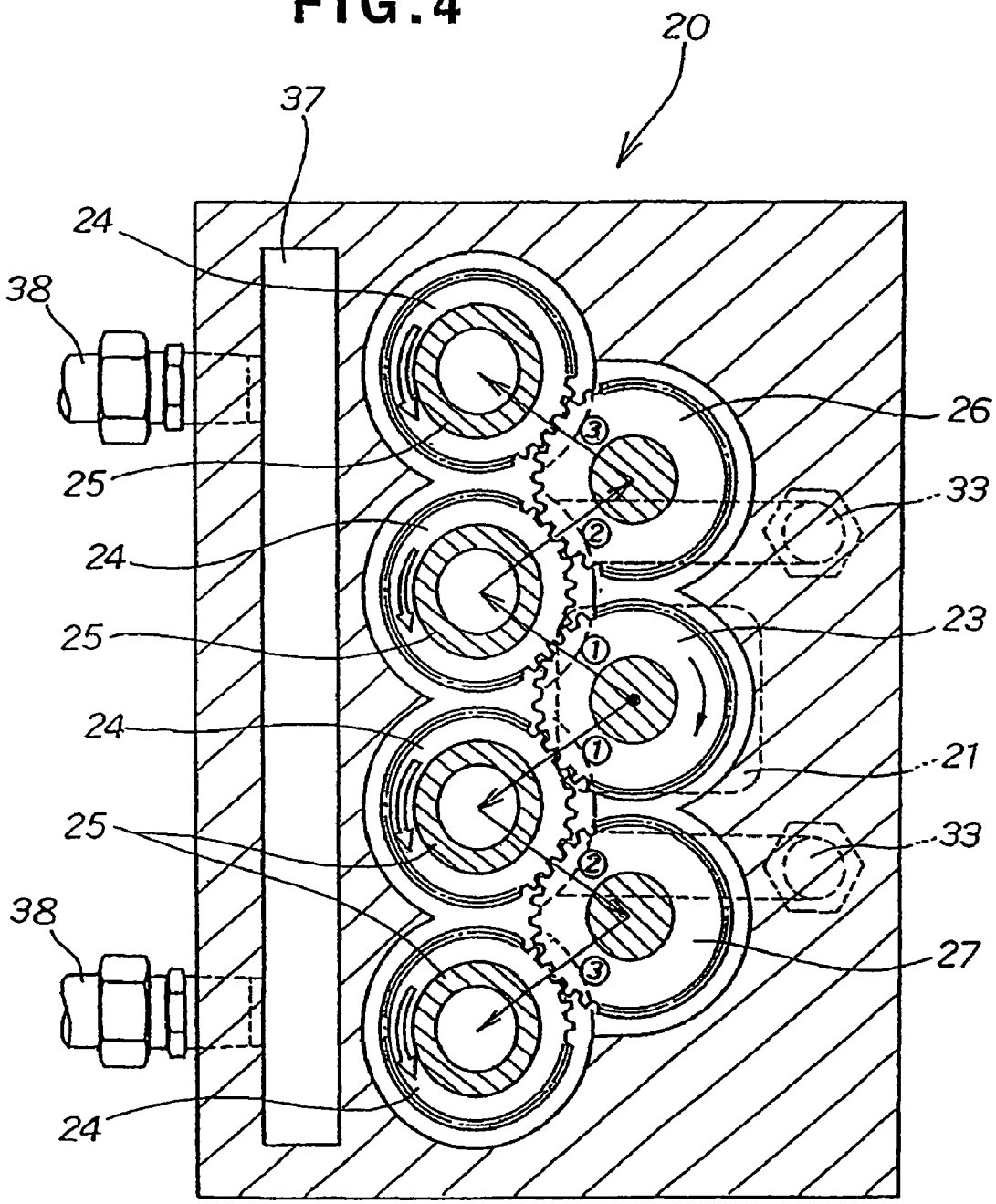
FIG. 4 is an enlarged sectional view taken along line 4—4 in FIG. 3.

Referring to FIG. 4, the drive gear 23 in the rotating mechanism 20 meshes with two inner gears 24 meshing with a first and a second transmission gear 26 and 27, respectively, which in turn mesh with two outer gears 24, respectively. Accordingly, the rotation of the motor 21 is transmitted first from the drive gear 23 to the two inner gears 24 as shown by arrows (1), from the inner gears 24 to the first and second transmission gears 26 and 27 as shown by arrows (2), and then from the first and second transmission gears 26 and 27 to the two outer gears 24 as shown by arrows (3). As a result, the four rotating shafts 25 to which the tour gears 24 are respectively attached are rotated together in the same direction as shown by white arrows to thereby cause the cylindrical electrodes 15 (FIG. 3) attached thereto to rotate in the same direction therewith.

Figure 5:
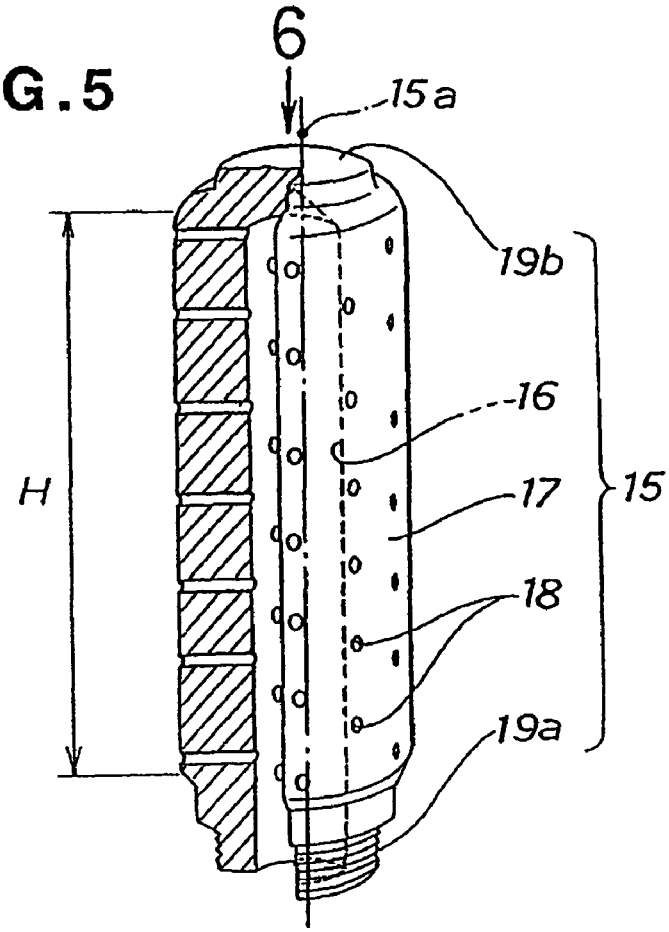
FIG. 5 is a perspective view, partly in section, of the cylindrical electrode shown in FIG. 3.
Figure 6:
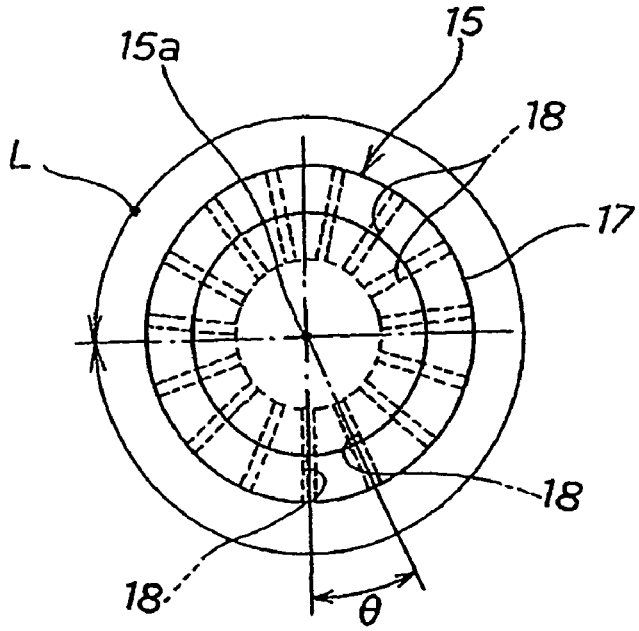
FIG. 6 is a top plan view of the cylindrical electrode as viewed along the arrow 6 in FIG. 5.

FIGS. 5 and 6 show a cylindrical electrode 15 in detail. Referring to FIG. 5, the cylindrical electrode 15 may be obtained by, for example, cladding a body of titanium (Ti) with platinum (Pt), or iridium oxide (IrO2). The cylindrical electrode 15 has the bore 16 extending along its longitudinal axis 15*a*, a cylindrical wall 17 facing the inner wall surface 2*a* of a cylinder in the cylinder block 1 (FIG. 3), the through holes 18 formed spirally in its wall 17, a top wall 19*b*, and the threaded portion 19*b* formed at its bottom. The wall 17 has its height B defined as shown in FIG. 5 and its circumferential length L defined as shown in FIG. 6, and its through holes 18 are so formed that every two adjoining holes may have an equal angle é (about 24°) therebetween, as shown in FIG. 6. For further details of the arrangement of the through holes 18., description will be made with reference to FIG. 7.

Figure 7:
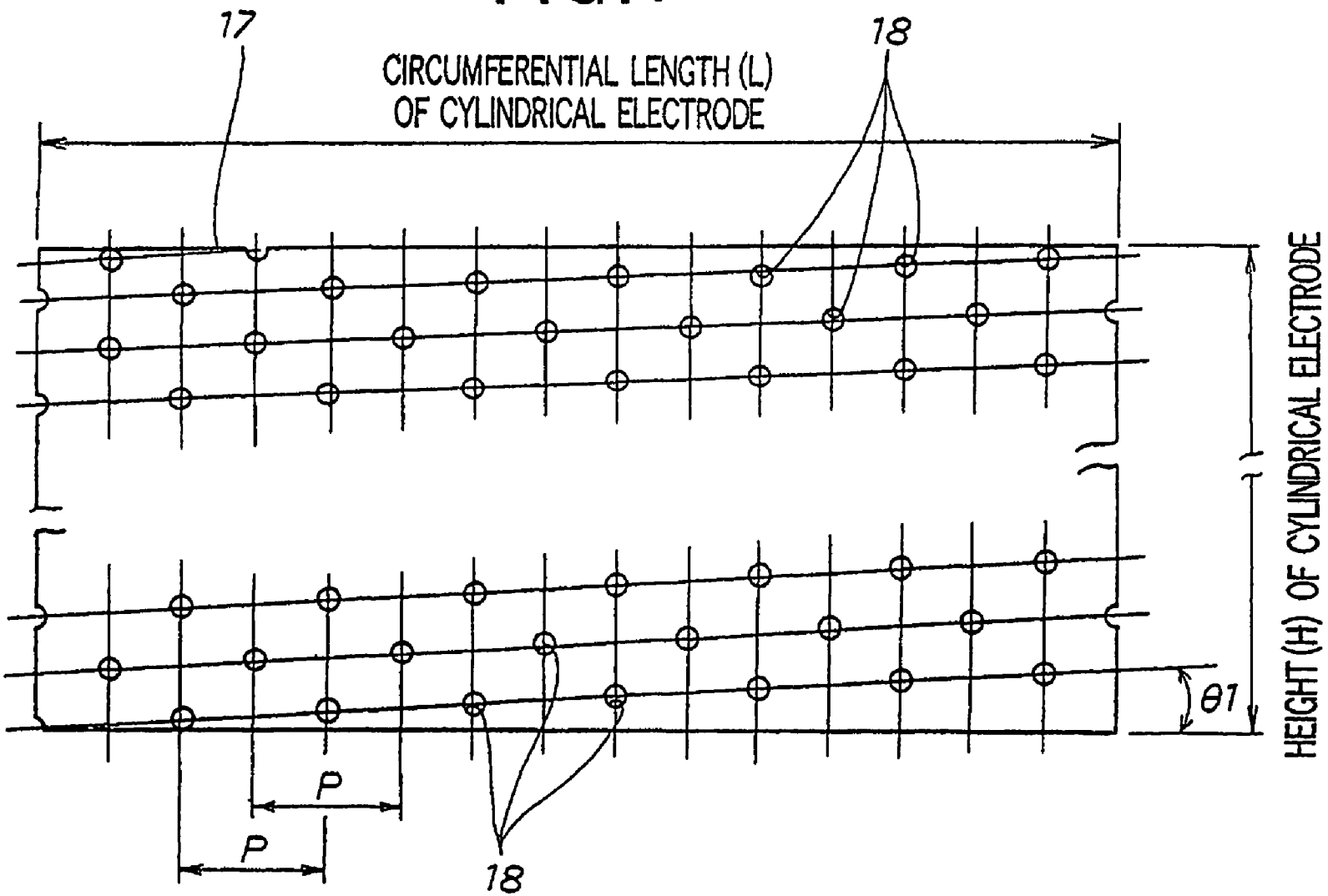
FIG. 7 is an unfolded view of the cylindrical electrode shown in FIG. 5.

FIG. 7 is an unfoled view of the cylindrical electrode shown in FIGS. 5 and 6. The holes 18 are arranged through the wall 17 in a zigzag array and spirally along lines inclined at an equal angle é1, and have an equal pitch P, as shown in FIG. 7. The spiral array of the holes 18 ensures the uniform impingement of the plating solution 29 upon the inner wall surface 2*a* of a cylinder in the cylinder block 1 (FIG. 3) facing the wall 17. The zigzag array thereof ensures the formation of the holes 18 with high density and with a small distance between every two adjoining holes 18, as compared with their array in a matrix.

Figure 8:
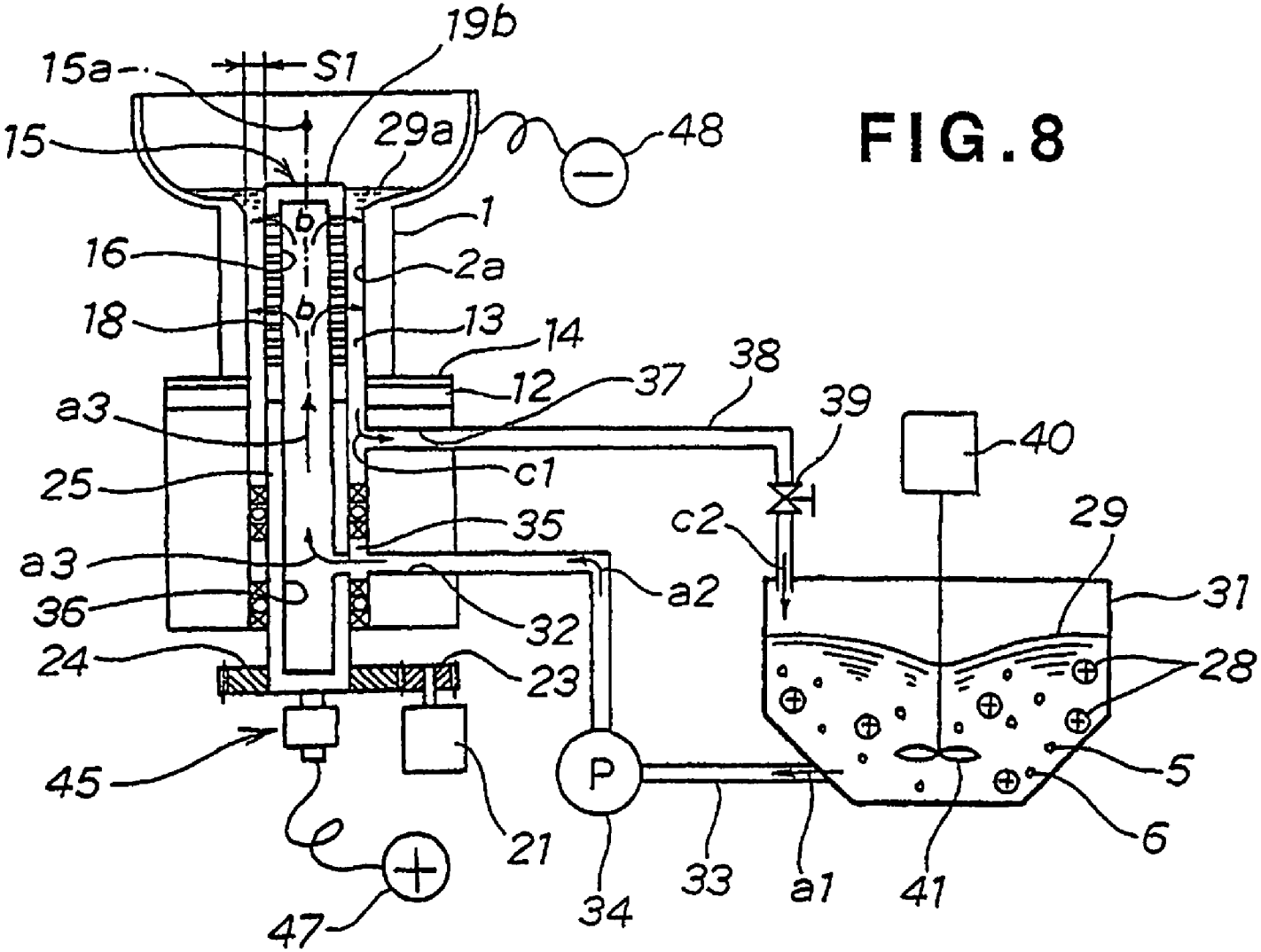
FIG. 8 is a diagram illustrating a process for forming a plating film of nickel and copper alloys according to this invention by using the composite plating apparatus shown in FIG. 3.

Description will now be made of a process for forming a composite plating film 3 of nickel and copper alloys on the inner wall surface 2*a* of a cylinder with reference to FIGS. 8 to 12. FIG. 8 shows the basic principle of the composite plating process according to this invention. A composite nickel and copper alloy plating solution 29 is first stored in the tank 31. The solution 29 contains nickel and copper which forms an alternate array of nickel and copper alloy layers on a base material (i.e. the inner wall surface 2*a* of a cylinder) upon application of a pulsed current, particles of at least one of C, h-BN and $MoS_2$ as self-lubricating particles, particles of at least one of SiC, $Si_3N_4$, $Al_2O_3$, c-BN and diamond as hard particles, a cationic surface active agent and sodium saccharate as a hardness raising agent. Metal ions (Ni and Cu ions) are shown at 28, self-lubricating particles at 5, and hard particles at 6.

The solution 29 is, for example, a solution which can form an alternate array of a nickel alloy layer consisting of nickel and less than 50% of copper and a copper alloy layer consisting of copper and less than 50% of nickel.

The solution may contain the self-lubricating particles 5 in the amount of $6\times10^{-5}$ to $4.2\times10^{-3}$ mol/cm$^3$. If their amount is smaller than $6\times10^{-5}$ mol/cm$^3$, there is formed a film 3 which is too low in lubricating property to ensure that no seizure be likely to occur. If their amount exceeds $4.2\times10^{-3}$ mol/cm$^3$ a higher electrical resistance brings about a lower plating efficiency.

The solution may contain the hard particles 6 in the amount of $7\times10^{-5}$ to $5\times10^{-3}$ mol/cm$^3$. If their amount is smaller than $7\times10^{-5}$ mol/cm$^3$, there is formed a film 3 which is so low in hardness as to get easily worn and be low in durability. If their amount exceeds $5\times10^{-3}$ mol/cm$^3$ a higher electrical resistance brings about a lower plating efficiency.

The solution may contain the surface active agent in the amount of $5\times10^{-3}$ to $1\times10^{-1}$ mol/cm$^3$. If its amount is smaller than $5\times10^{-3}$ mol/cm$^3$ it may fail to activate the self-lubricating particles 5 for an improved lubrication and thereby an improved composition efficiency. If its amount exceeds 1×10−1 mol/cm3, a higher electrical resistance brings about a lower plating efficiency.

The solution may contain the hardness raising agent in the amount of $5\times10^{-6}$ to $3\times10^{-5}$ mol/cm$^3$. If its amount is smaller than $5\times10^{-6}$ mol/cm$^3$, it may fail to strain or finely divide the crystals and thereby form a film 3 of improved hardness. If its amount exceeds $3\times10^{-5}$ mol/cm$^3$, a higher electrical resistance brings about a lower plating efficiency.

After the solution 29 has been stored in the tank 31, the cylinder block 1 is placed on the insulating member 14 for the work table 12 and over the cylindrical electrode 15 with the clearance S1 held therebetween. Then, the motor 21 is driven so that its rotation may be transmitted to the rotating shaft 25 through the drive gear 23 and the gears 24 to rotate the cylindrical electrode 15 about its longitudinal axis 15*a*.

Then, the impeller 41 of the stirrer 40 is rotated to stir the solution 29 in the tank 31. Then, the pump 34 is driven to supply the solution 29 from the tank 31 to the bore 16 of the cylindrical electrode 15 through the first supply passage 33, supply port 32, chamber 35 and second supply passage 36 as shown by arrows a1 to a3. The solution 29 jets out of the bore 16 of the cylindrical electrode 15 through its holes 18 and strikes against the inner wall surface 2*a* of a cylinder in the cylinder block 1 at right angles thereto, as shown by arrows b. The solution 29 is, then, collected in the tank 31 through the circulating passage 13, collecting port 37 and collecting passage 38, as shown by arrows c1 and c2. A plating current (pulsed) is supplied to the cylindrical electrode 15 and the cylinder block 1 by the mechanism 45, while the solution 29 is in circulation as described.

Figure 9:
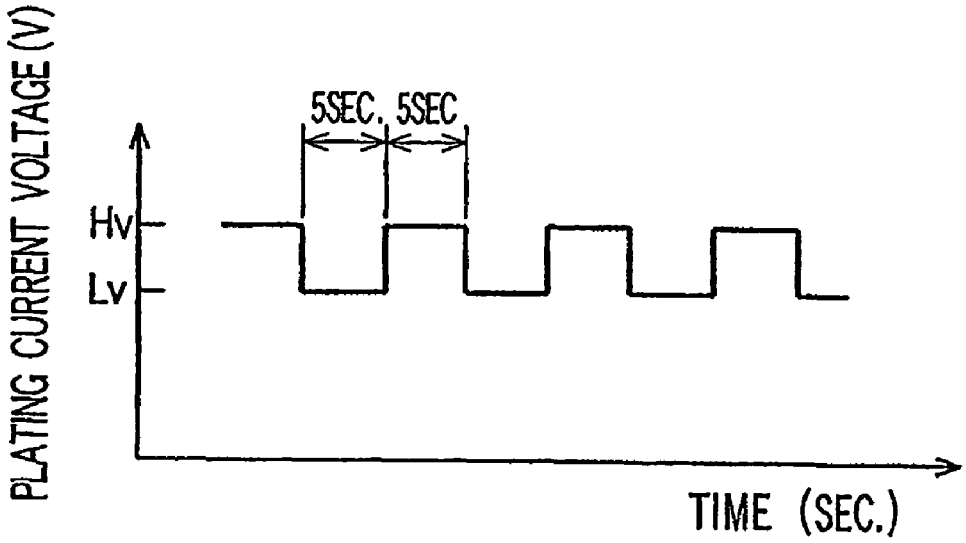
FIG. 9 is a diagram showing the waveform of a pulsed electric current used for carrying out the process as shown in FIG. 8.

FIG. 9 shows the waveform of the pulsed plating current. An electric current having a high voltage Hv and an electric current having a low voltage Lv are supplied alternately for a certain length of time (e.g. five seconds) each, as shown in FIG. 9. The high voltage Hv is intended for depositing a nickel alloy layer consisting of nickel and less than 50% of copper, and the low voltage Lv for depositing a copper alloy layer consisting of copper and less than 50% of nickel. The duration of application of each of the high and low voltages Hv and Lv is five seconds according to the example shown, but may be varied as required.

Figure 10:
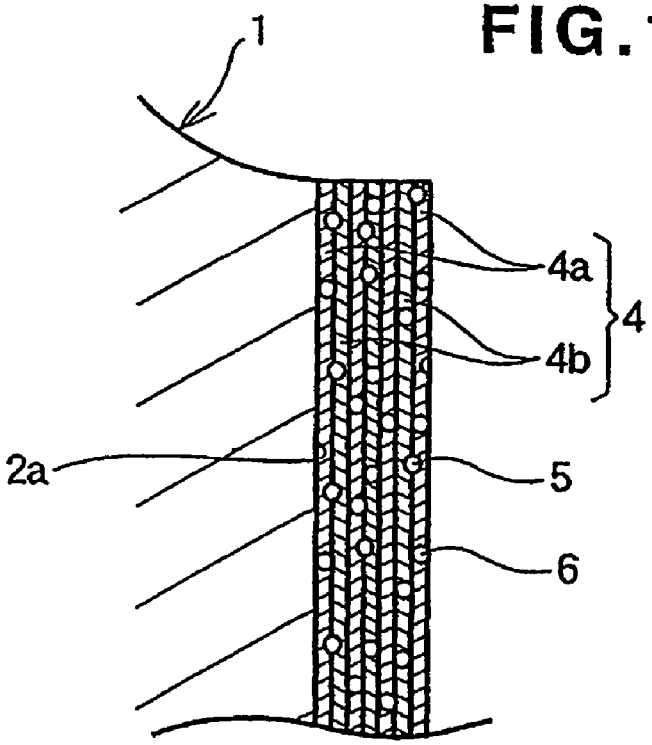
FIG. 10 is an enlarged view of a part of a composite plating film formed as an alternate array of nickel and copper alloy layers on the inner wall surface of a cylinder.

FIG. 10 shows a matrix 4 of nickel and copper alloys as deposited by employed a pulsed current. A current having a high voltage Hv is supplied for five seconds to deposit a nickel alloy layer 4*a* on the inner wall surface 2*a* of a cylinder. Then, a current having a low voltage Lv is supplied for five seconds to deposit a copper alloy layer 4*b* on the nickel alloy layer 4*a*. More nickel and copper alloy layers 4*a* and 4*b* are thereafter deposited on each other to form a matrix 4 consisting of an alternate array of nickel and copper alloy layers 4*a* and 4*b*. Self-lubricating and hard particles 5 and 6 are also deposited with the nickel and copper alloy layers 4*a* and 4*b*.

Figure 11:
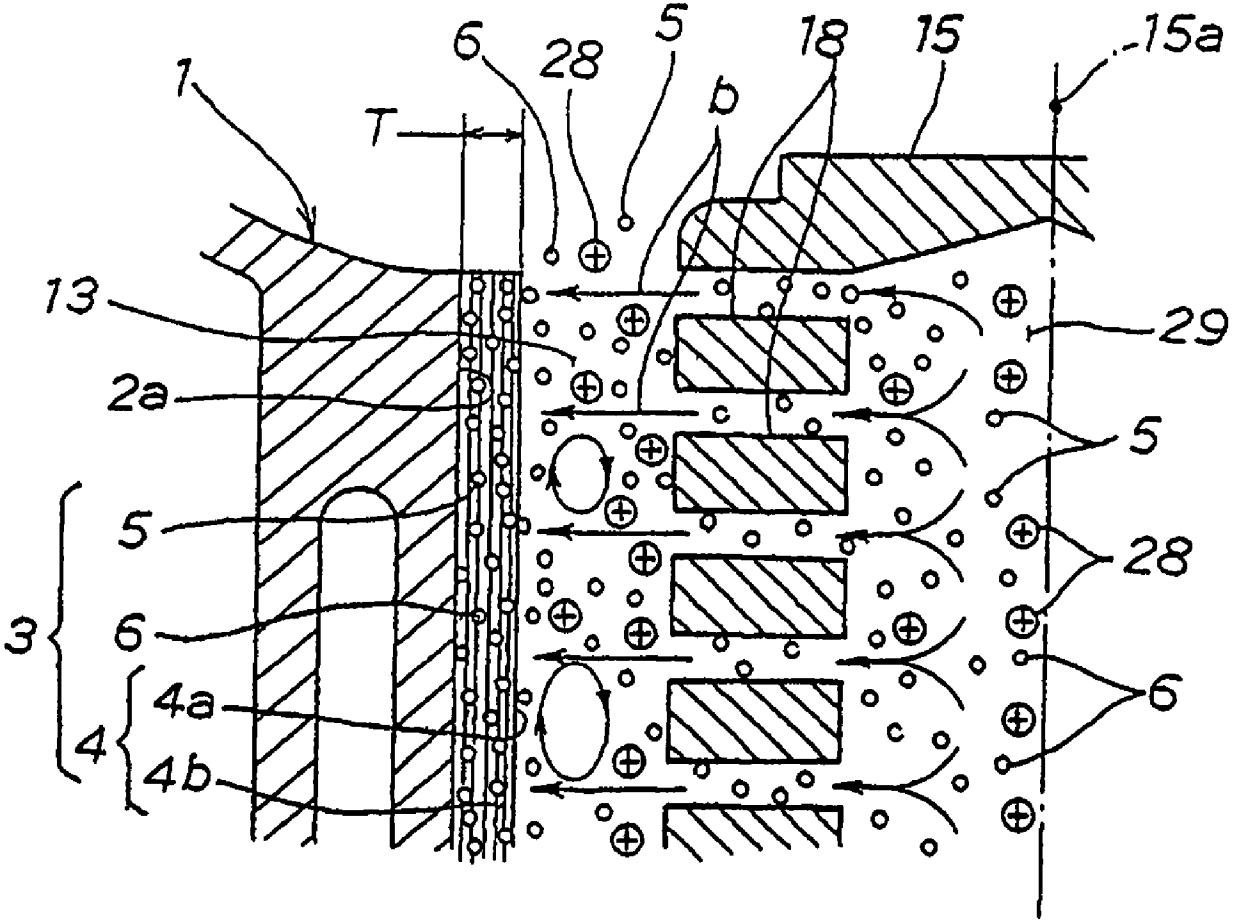
FIG. 11 is a diagram illustrating the formation of a composite plating film of nickel and copper alloys on the inner wall surface of a cylinder from a Ni—Cu composite coating solution jetted out from a cylindrical electrode to the inner wall surface of the cylinder.

FIG. 11 shows the solution 29 jetting out through the holes 18 in the wall of the cylindrical electrode 15. The solution 29 strikes against the inner wall surface 2*a* of a cylinder in the cylinder block 1 substantially at right angles thereto and forms a turbulent flow. Moreover, it jets out at a substantially equal speed through all the holes 18 and thereby strikes uniformly against the whole inner wall surface 2*a*. Accordingly, the metal (Ni and Cu) ions 28, self-lubricating particles 5 and hard particles 6 are dispersed uniformly in the solution 29. As a result, the metal ions 28 in the vicinity of the inner wall surface 2*a* can be maintained at a specific concentration, so that a matrix 4 consisting of nickel and copper alloy layers 4*a* and 4*b* can be deposited with a uniform thickness T. As the self-lubricating and hard particles 5 and are also dispersed uniformly in the solution 29 in the vicinity of the inner wall surface 2*a*, the matrix 4 contains specific amounts of self-lubricating and hard particles 5 and 6 dispersed uniformly therein.

Moreover, the rotation of the cylindrical electrode 15 ensures that the solution 29 jetting out through the holes 18 strike uniformly against the whole inner wall surface 2*a*. Thus, the matrix has a uniform thickness over the whole inner wall surface 2*a* and contains the self-lubricating and hard particles 5 and 6 dispersed uniformly therein.

Figure 12:
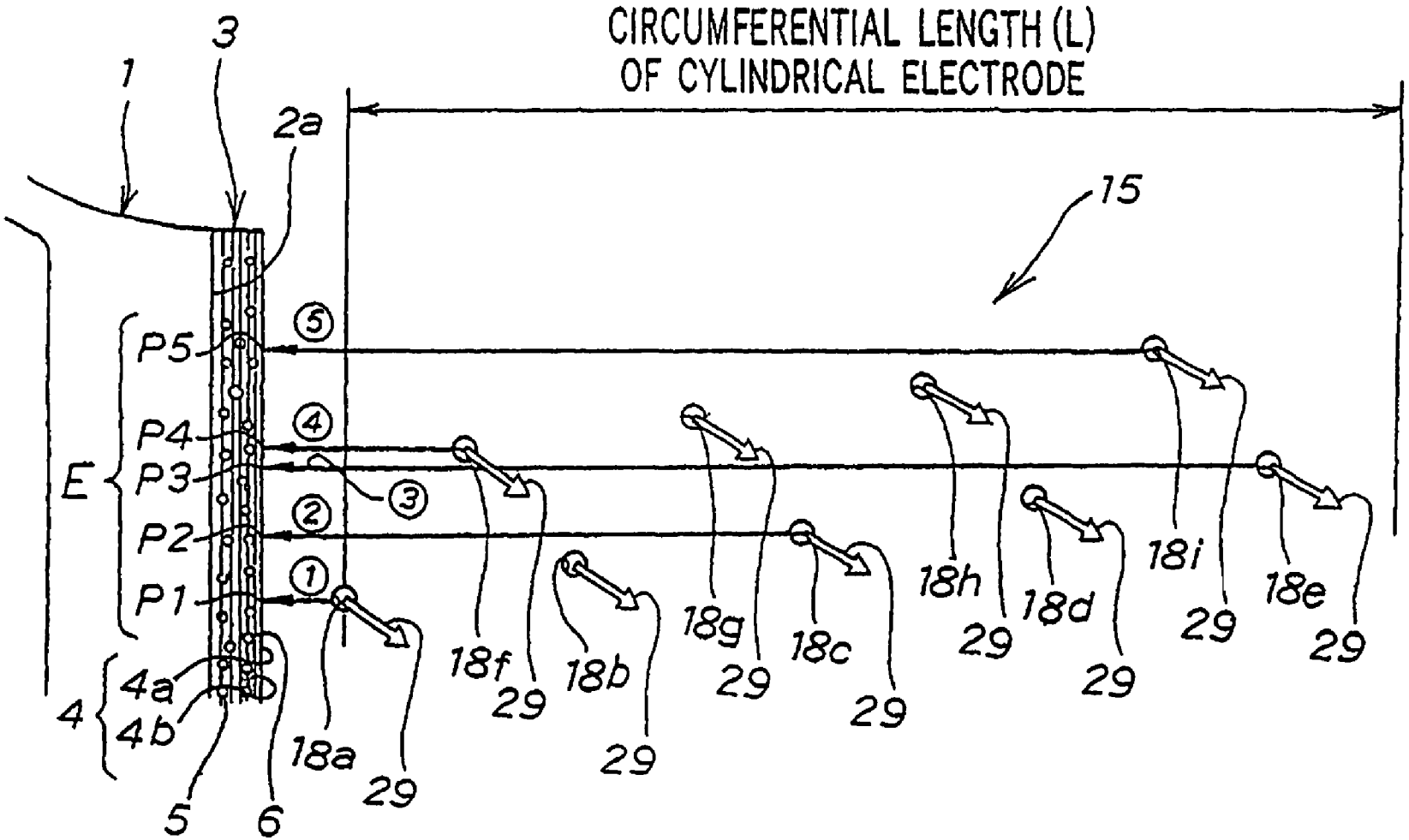
FIG. 12 is an unfolded view of the cylindrical electrode showing the coating solution jetted out therefrom as shown in FIG. 11.

FIG. 12 shows the cylindrical electrode 15 in an unfolded form on the right side of a portion of the cylinder block 1. The holes 18 are shown as 18*a* to 18*i* for the sake of convenience. The cylindrical electrode 15 (see FIG. 5) is rotated, while the solution is caused to jet out through the holes 18*a* to 18*i*. The solution leaving the hole 18*a* strikes against the inner wall surface 2*a* at a position P1 as shown by an arrow (1), and the solution leaving the hole 18*b* strikes thereagainst slightly above the position P1. The solution 29 leaving the hole 18*c* strikes thereagainst at a position P2 as shown by an arrow (2), while the solution 29 leaving the hole 18*d* strikes thereagainst slightly above the position P2, and the solution 29 leaving the hole 18*e* strikes thereagainst at a position P3 as shown by an arrow (3). The solution 29 leaving the hole 18*f* strikes thereagainst at a position P4 as shown by an arrow (4), while the solution 29 leaving the hole 18*g* strikes thereagainst at a level slightly above the position P4, and the solution 29 leaving the hole 18*h* at a slightly higher level. The solution 29 leaving the hole 18*i* strikes thereagainst at a position P5 as shown by an arrow (5). Thus, the solution 29 strikes against the inner wall surface 2*a* uniformly over an area E extending between the positions P1 and P5. As a result, it is possible to deposit a matrix 4 of nickel and copper alloy layers 4*a* and 4*b* with a specific thickness on the surface 2*a*, while maintaining the concentration of the metal (Ni and Cu) ions in the solution 29 at a specific level. Moreover, it is possible to mix the self-lubricating and hard particles 5 and 6 uniformly in the solution 29 and thereby disperse them uniformly in the matrix 4, whereby a composite nickel and copper alloy plating film 3 is formed on the surface 2*a*.

Figure 13:
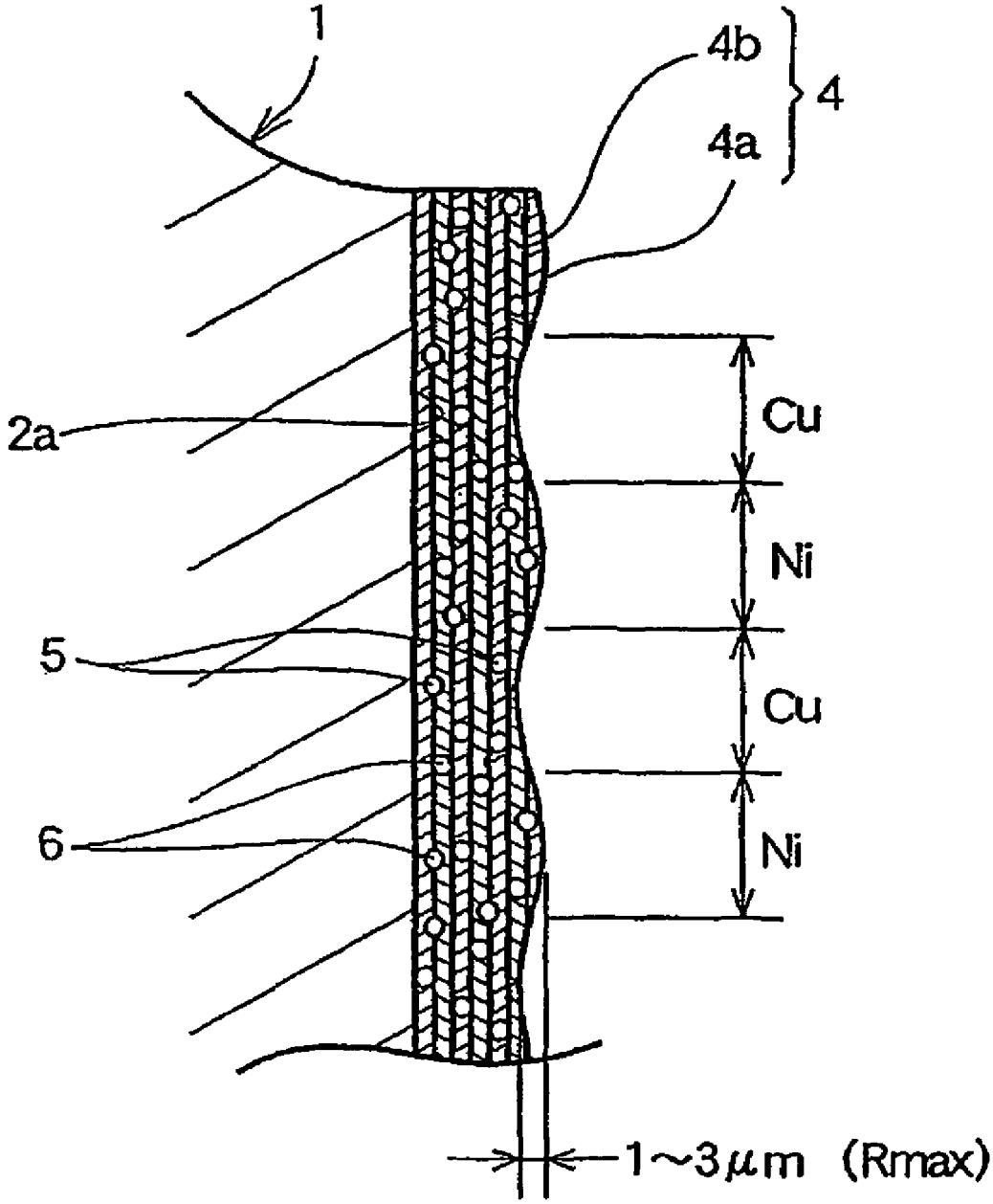
FIG. 13 is an enlarged view of a part of a composite plating film formed on the inner wall surface of a cylinder from an alternate array of nickel and copper alloy layers and having its surface roughened to have the nickel and copper alloys exposed substantially uniformly.

FIG. 13 shows a surface finish on the film 3 according to this invention. Its surface finish may be done by, for example, honing. The film 3 has its surface roughened to a roughness of one to three microns as indicated by maximum height (Rmax). This makes it possible to expose the nickel and copper alloy layers 4*a* and 4*b* substantially uniformly on the surface of the film 3.

The nickel alloy layer 4*a* is of high wear resistance owing to nickel. The copper alloy layer 4*b* is of high corrosion resistance owing to copper. Therefore, the substantially uniform exposure of the nickel and copper alloy layers 4*a* and 4*b* on the surface of the film 3 ensures its high wear and corrosion resistances.

Explanation has to be given of the reasons why the film 3 has its surface roughened to a roughness (Rmax) of one to three microns. If its roughness (Rmax) is less than one micron, the nickel alloy layer 4*a* cannot be cut away satisfactorily to expose the copper alloy layer 4*b* to as desired. If its roughness (Rmax) exceeds three microns, it is too rough for the desired flatness of the film 3. Moreover, the concavities formed in the roughened surface of the film 3 can be employed to hold a lubricant to reduce any sliding resistance on the film 3.

The film 3 contains the self-lubricating and hard particles 5 and 6 in its nickel and copper alloy matrix 4. The self-lubricating particles 5 ensure the lubricating property of the film 3. The hard particles 6 harden the film 3 and ensure its high wear resistance.

The self-lubricating particles 5 are of at least one of graphite (C), hexagonal boron nitride (h-BN) and molybdenum disulfide ($MOS_2$). The particles of C, h-BN or $MOS_2$ are a solid lubricant having a hexagonal crystal structure and exhibit a high level of lubricating property even where no lubricant oil is available. The hard particles 6 are of at least one of silicon carbide (SiC), silicon nitride ($Si_3N_4$), alumina ($Al_2O_3$), cubic boron nitride (c-BN) and diamond. They have a Vickers hardness (Hv) of 3,000 or above, and ensure the high wear resistance of the film 3.

The solution 29 further contains sodium saccharate as a hardness raising agent. It strains or finely divided the crystals of the materials in the film 3 and thereby improves its hardness.

The film 3 contains 2 to 15% by volume of each of self-lubricating and hard particles 5 and 6. If the proportion of the self-lubricating particles 5 is lower than 2% by volume, the film 3 is unsatisfactory in lubrication and seizure is likely to occur. If their proportion exceeds 15% by volume, a higher electric current is required and results in a lower plating efficiency. If the proportion of the hard particles 6 is lower than 2% by volume, the film 3 is unsatisfactorily low in hardness and wear resistance. If their proportion exceeds 15% by volume, a higher electric current is required and results in a lower plating efficiency.

The composite nickel and copper alloy plating film 3 according to this invention has its nickel and copper alloy layers 4*a* and 4*b* exposed substantially uniformly on its surface, and contains the self-lubricating and hard particles 5 and 6, the surface active agent which activates the self-lubricating particles 5 to a further extent, and the hardness raising agent which strains or finely divides the crystals. Thus, the film 3 is high in wear resistance, corrosion resistance and lubricating property.

Figure 2:
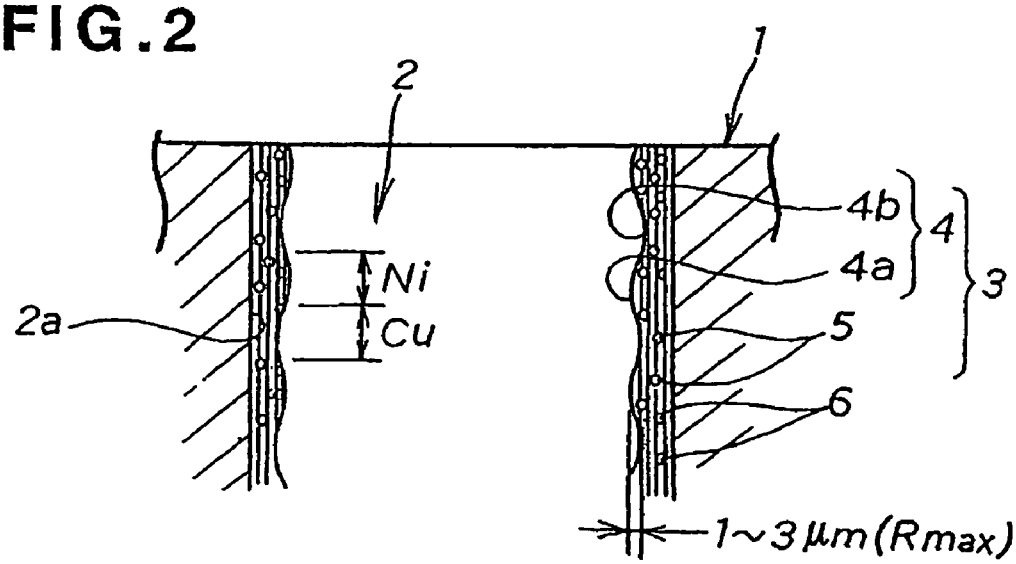
FIG. 2 is a sectional view taken along line 2—2 in FIG. 1 and showing a first embodiment of this invention.
Figure 14:
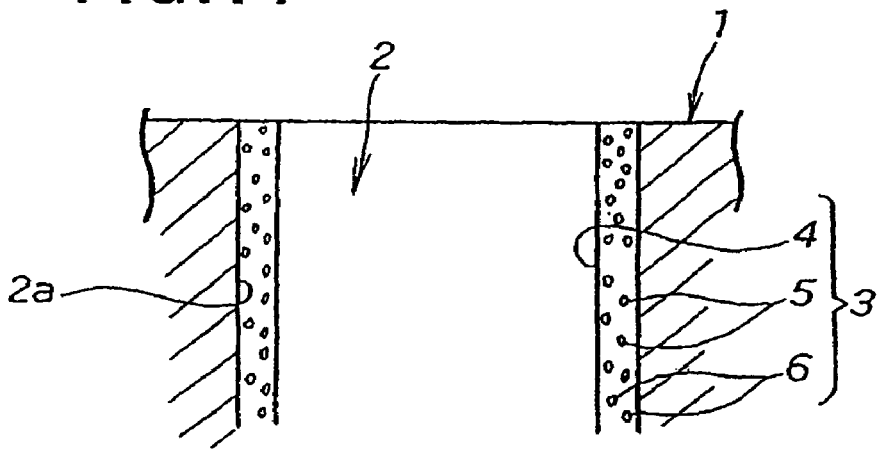
FIG. 14 is a view similar to FIG. 2, but showing a single-layered composite plating film formed on the inner wall surface of a cylinder in accordance with a second embodiment of this invention.

Description will now be made as to a composite plating film according to a second embodiment of this invention. FIG. 14 corresponds to FIG. 2 showing the film according to the first embodiment thereof, and shows a single-layered film as opposed to a multilayered film according to the first embodiment.

The film 3 according to the second embodiment of this invention comprises a nickel and copper alloy matrix 4 containing nickel and 10 to 50 atm. % of copper, formed on the inner wall surface 2*a* of a cylinder and further containing self-lubricating and hard particles 5 and 6 dispersed substantially uniformly therein. The film 3 is highly resistant to sulfuric acid owing to the copper which it contains.

The matrix contains 10 to 50 atm. % of copper. If its copper content is lower than 10 atm. %, the film 3 is undesirably low in corrosion resistance. If it exceeds 50 atm. %, its nickel content is too low to ensure the wear resistance of the film 3. Further explanation of the reasons for the copper range of 10 to 50 atm. % will be given later with reference to FIGS. 15A to 16B.

The matrix 4 also contains the self-lubricating particles 5 which raise the lubricating property of the film 3. The self-lubricating particles 5 are of at least one of graphite (C), hexagonal boron nitride (h-BN) and molybdenum disulfide ($MOS_2$). The particles of C, h-BN or $MOS_2$ are a solid lubricant having a hexagonal crystal structure and exhibit a high level of lubricating property even where no lubricant oil is available.

Moreover, the matrix 4 contains the hard particles 6 which harden the film 3 and raise its wear resistance. The hard particles 6 are of at least one of silicon carbide (Sic), silicon nitride ($Si_3N_4$), alumina ($Al_2O_3$), cubic boron nitride (c-BN) and diamond. They have a Vickers hardness (Hv) of 3,000 or above, and ensure the high wear resistance of the film 3.

The film 3 contains 2 to 15% by volume of each of self-lubricating and hard particles 5 and 6. If the proportion of the self-lubricating particles 5 is lower than 2% by volume, the film 3 is unsatisfactory in lubrication and seizure is likely to occur. If their proportion exceeds 15% by volume, a higher electric current is required and results in a lower plating efficiency if the proportion of the hard particles 6 is lower than 2% by volume, the film 3 is unsatisfactorily low in hardness and wear resistance. If their proportion exceeds 15% by volume, a higher electric current is required and results in a lower plating efficiency.

The composite nickel and copper alloy plating film 3 as described above is formed on the inner wall surface 2*a* of each cylinder in a cylinder block 1 for an internal combustion engine. The film 3 is so high in corrosion resistance as to protect the surface 2*a* from corrosion by sulfuric acid. The film 3 is also high in wear resistance and restrains the wear of the inner wall surface 2*a* of the cylinder. Moreover, it is so high in lubricating property as to prevent any seizure from occurring to the surface 2*a* when the engine is started. Thus, the film 3 raises the durability or life of the engine to a further extent.

The composite plating film according to the second embodiment of this invention can be formed by employing the apparatus as described with reference to FIGS. 3 to 7 in connection with the first embodiment. No description of the apparatus is, therefore, repeated. Moreover, it can be formed by employing the process as described with reference to FIGS. 8, 11 and 12 in connection with the first embodiment. No description of the process is, therefore, repeated, either. It is, however, to be noted that a constant current is employed instead of a pulsed current for carrying out the process according to the second embodiment.

The composite nickel and copper alloy plating solution 29 stored in the tank 31 as shown in FIG. 8 and employed for carrying out the second embodiment of this invention contains nickel, copper, citric acid, at least one of C, h-BN and $MOS_2$ as self-lubricating particles, at least one of SiC, $Si_3N_4$, $Al_2O_3$, c-BN and diamond as hard particles, a cationic surface active agent and sodium saccharate as a hardness raising agent. No statement is made of the amounts and effects of the self-lubricating or hard particles 5 or 6, surface active agent, or hardness raising agent in the solution 29, since they have already been stated in connection with the first embodiment of this invention. The solution 29 contains citric acid in addition to the components of the solution employed for the first embodiment. Citric acid serves as a complex-forming agent, and ensures the complete dissolution of copper in the solution 29 and thereby the satisfactory deposition of copper without allowing any sedimentation thereof.

Figure 15A:
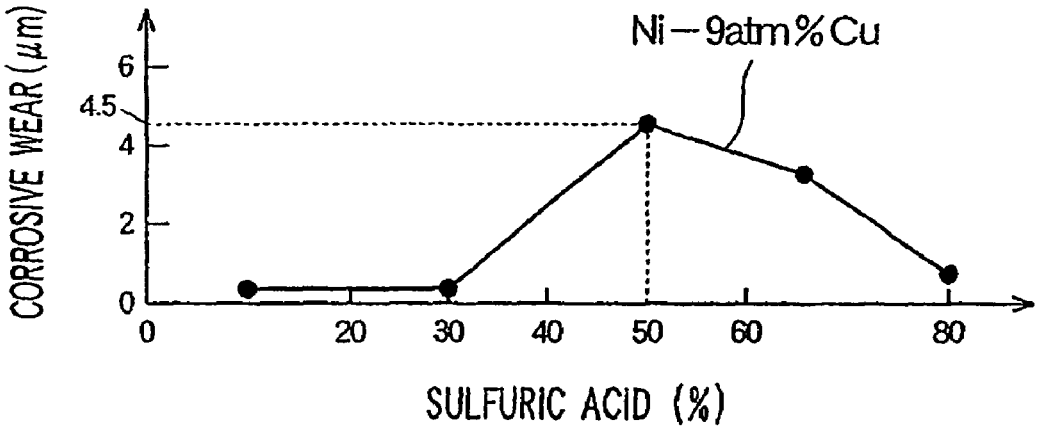
FIG. 15A is a graph showing the corrosive wear of a composite plating film of nickel and copper alloys according to a comparative example in relation to the concentration of sulfuric acid.
Figure 15B:
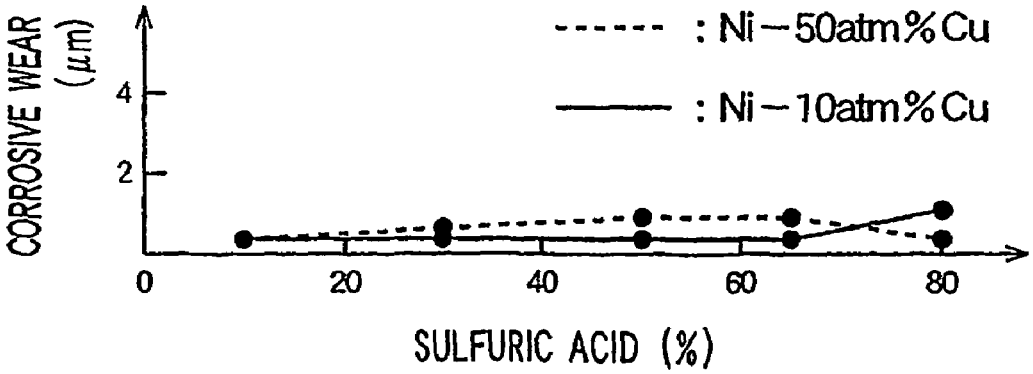
FIG. 15B is a graph similar to FIG. 15A, but showing the results as obtained with films according to the second embodiment of this invention.

FIG. 15A or 15B is a graph showing the corrosive wear of a composite nickel and copper alloy plating film according to a comparative example or the second embodiment of this invention in relation to the concentration of sulfuric acid in an aqueous solution to which the film is exposed. The concentration of sulfuric acid is plotted along the x-axis, and the corrosive wear along the y-axis. The graph shows the results of electrochemical measurements made as will now be explained. The film serving as the anode is dipped in an aqueous solution of sulfuric acid having a temperature set at about 80° C., and after 10 minutes, electrolysis is conducted by passing an electric current through the solution at a rate of 50 mV per minute, so that the corrosive wear of the film may be determined. The corrosive wear is the wear which grows on a friction surface undergoing a chemical change for deterioration and having a deteriorated portion lost as a result of an interaction, and oxidation is, for example, a kind of corrosive wear.

Referring to FIG. 15A, the comparative film formed from a nickel alloy containing 9 atm. % of copper shows an increase of corrosive wear when the concentration of sulfuric acid exceeds 30%, and its wear amounts to 4.5 microns when the concentration of sulfuric acid is 50%. It, therefore, follows that a copper content of 9 atm. % is too low for any alloy of satisfactory corrosion resistance. Referring now to FIG. 15B, the film embodying this invention and formed from a nickel alloy containing 10 atm. % of copper undergoes a corrosive wear of only less than two microns irrespective of the concentration of sulfuric acid, as shown by a curve in a solid line. It, therefore, follows that a copper content of 10 atm. % is satisfactory for an alloy of satisfactory corrosion resistance. The same is true of the film embodying this invention and formed from a nickel alloy containing 50 atm. % of copper, as shown by a curve in a broken line, and it follows that a copper content of 50 atm. % is likewise satisfactory. Thus, it is obvious that a nickel and copper alloy having a copper content of 10 atm. % or above can make a composite plating film of high corrosion resistance.

Figure 16A:
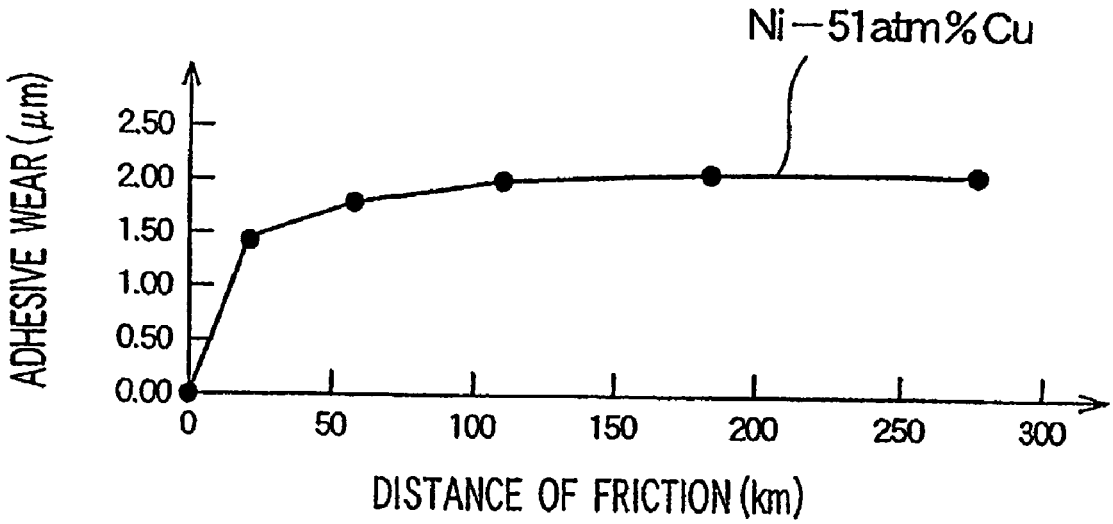
FIG. 16A is a graph showing the adhesive wear of a composite plating film of nickel and copper alloys according to a comparative example in relation to a distance of friction.
Figure 16B:
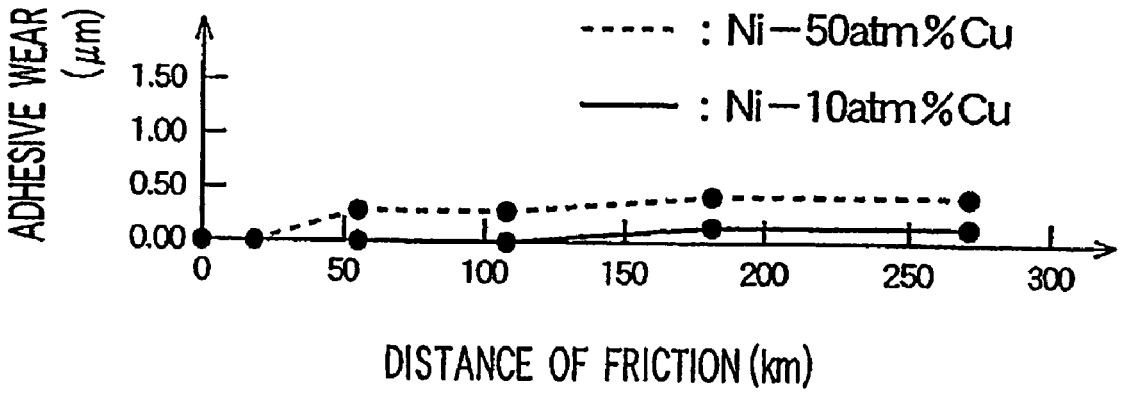
FIG. 16B is a graph similar to FIG. 16A, but showing the results as obtained with films according to the second embodiment of this invention.

FIG. 16A or 16B is a graph showing the adhesive wear of a composite nickel and copper alloy plating film according to a comparative example or the second embodiment of this invention in relation to the distance of friction. The distance of friction is plotted along the x-axis, and the adhesive wear along they-axis. The adhesive wear is a normal kind of wear which occurs when two metals adhere to each other in a friction surface and the softer of the two is torn and migrates to the other.

Referring to FIG. 16A, the comparative film formed from a nickel and copper alloy containing 51 atm. % of copper has an adhesive wear of 1.5 microns at a friction distance of about 20 km, a greater wear of 1.8 microns at a distance of about 50 km and a still greater wear of 2.0 microns at or above a distance of 100 km. It, therefore, follows that a copper content of 51 atm. % is too high for any alloy of satisfactory wear resistance. Referring now to FIG. 16B, the film embodying this invention and formed from a nickel and copper alloy containing 50 atm. % of copper has an adhesive wear of only about 0.25 micron at a friction distance of about 50 km and a wear smaller than 0.5 micron even at a distance over 100 km, as shown by a curve in a broken line, and it follows that a copper content of 50 atm. % is satisfactory for an alloy of satisfactory wear resistance. The film embodying this invention and formed from a nickel and copper alloy containing 10 atm. % of copper has an adhesive wear of virtually zero until a friction distance over 100 km and a wear smaller than 0.1 micron even at a distance over 180 km, as shown by a curve in a solid line, and it follows that a copper content of 10 atm. % is likewise satisfactory. Thus, it is obvious that a nickel and copper alloy having a copper content not exceeding 50 atm. % can make a composite plating film of high wear resistance.

EXAMPLES

Some examples of experiments according to this invention will now be described with reference to Tables 1 and 2. It is, however, to be understood that these examples are not intended for limiting the scope of this invention.

TABLE 1

| | | | |
|---|---|---|---|
| Plating solution | Composite plating film | | Ni—Cu + BN + SiC |
| | Nickel sulfate | | 0.415 g/cm$^3$ |
| | Copper sulfate | | 0.05~0.08 g/cm$^3$ |
| | Trisodium citrate | | 0.1~0.16 g/cm$^3$ |
| | Boric acid | | 0.035 g/cm$^3$ |
| | Sodium saccharate | | $5 \times 10^{-5}$~$3 \times 10^{-5}$ mol/cm$^3$ |
| | Silicon carbide (SiC) | | 0.001~0.005 mol/cm$^3$ |
| | Boron nitride (h-BN) in suspension | | $4 \times 10^{-4}$~$4 \times 10^{-3}$ mol/cm$^3$ |
| | pH | | 5.0 |
| | Temperature | | 60° C. |
| Cylindrical electrode | Hole diameter | | 2.0 mm |
| | Number of holes | | 169 |
| | Inside diameter | | 25.0 mm |
| | Rotating speed | | 5 rpm |
| | Plating method | | High-speed jet plating |
| Plating conditions | Initial | Solution flow rate | $30 \times 10^3$ cm$^3$/min. |
| | | Current density | 14 A/dm$^2$ |
| | | Time | 1 min. 10 sec. |
| | Regular | Solution flow rate | $30 \times 10^3$ cm$^3$/min. |
| | | Current density | 20~40 A/dm$^2$ |
| | | Time | 6 min. 51 sec.–13 min. 40 sec. |
| Results | Film thickness | | 56.5 μm |
| | per content | | 30 atm % |
| | Boron nitride (h-BN) | | 2~15 vol % |
| | Silicon carbide (SiC) | | 2~15 vol % |

Experiment 1

Description is made of an example in which a composite plating film 3 was formed by a nickel and copper alloy matrix containing 30 atm. % of copper, h-BN as self-lubricating particles and SiC as hard particles. The film 3 contained 2 to 15% by volume of each of h-BN and SiC.

A composite plating solution 29 (see FIG. 3) contained 0.415 g/cm$^3$ of nickel sulfate ($NiSO_4$), 0.05 to 0.08 g/cm$^3$ of copper sulfate ($CuSO_4$), 0.1 to 0.16 g/cm$^3$ of trisodium citrate, 0.035 g/cm$^3$ of boric acid and $5\times10^{-6}$ to $3\times10^{-5}$ mol/cm$^3$ of sodium saccharate, and had a pH of 5.0. It also contained h-BN and SiC particles suspended in the amounts of $4\times10^{-4}$ to $4\times10^{-3}$ mol/cm$^3$ and 0.001 to 0.005 mol/cm$^3$, respectively, and had a temperature of 60° C. Each cylindrical electrode 15 (see FIG. 5) had 169 through holes 18 made in its cylindrical wall 17 and each having a diameter of 2.0 mm.

Referring to the composite plating conditions, an electric current was first supplied to the cylindrical electrode 15 and a cylinder block 1 at a current density of 14 A/dm$^2$ for one minute and 10 seconds, while the cylindrical electrode was rotated at a speed of 5 rpm and the plating solution 29 was circulated at a rate of $30\times10^3$ cm$^3$/min. Then, an electric current was supplied to the cylindrical electrode 15 and the cylinder block 1 at a current density of 20 to 40 A/dm$^2$ for six minutes and 51 seconds to 13 minutes and 40 seconds, while the cylindrical electrode was rotated at a speed of 5 rpm and the plating solution 29 was circulated at a rate of 30 l/min.

As a result, there was formed a film having a thickness of 56.5 microns. Its nickel and copper alloy matrix contained 30 atm. % of copper. Its copper content of 30 atm. % falls within the range of 10 to 50 atm. % as explained with reference to the graphs of FIGS. 15A to 16B. It, therefore, follows that the film is satisfactorily high in corrosion and wear resistances. It also contained 2 to 15% by volume of h-BN and 2 to 15% by volume of SiC. They ensure the satisfactorily high lubricating property of the film Its lubricating property will be explained in detail with reference to FIG. 20 later.

TABLE 2

| | | | |
|---|---|---|---|
| Plating solution | Composite plating film | | Ni—Cu + C + SiC |
| | Nickel sulfate | | 0.415 g/cm$^3$ |
| | Copper sulfate | | 0.05~0.08 g/cm$^3$ |
| | Trisodium citrate | | 0.1~0.16 g/cm$^3$ |
| | Boric acid | | 0.035 g/cm$^3$ |
| | Sodium saccharate | | $5\times10^{-5}$~$3\times10^{-5}$ mol/cm$^3$ |
| | Silicon carbide (SiC) | | 0.001~0.005 mol/cm$^3$ |
| | Graphite (C) in suspension | | $4\times10^{-4}$~$4.2\times10^{-3}$ mol/cm$^3$ |
| | pH | | 5.0 |
| | Temperature | | 60° C. |
| Cylindrical electrode | Hole diameter | | 2.0 mm |
| | Number of holes | | 169 |
| | Inside diameter | | 25.0 mm |
| | Rotating speed | | 5 rpm |
| | Plating method | | High-speed jet plating |
| Plating conditions | Initial | Solution flow rate | $30\times10^3$ cm$^3$/min. |
| | | Current density | 14 A/dm$^2$ |
| | | Time | 1 min. 10 sec. |
| | Regular | Solution flow rate | $30\times10^3$ cm$^3$/min. |
| | | Current density | 20~40 A/dm$^2$ |
| | | Time | 6 min. 51 sec.–13 min. 40 sec. |
| Results | Film thickness | | 56.5 μm |
| | per content | | 30 atm % |
| | Graphite (C) | | 2~15 vol % |
| | Silicon carbide (SiC) | | 2~15 vol % |

Experiment 2

Description is made of an example in which a composite plating film 3 was formed by a nickel and copper alloy matrix containing 30 atm. % of copper, C as self-lubricating particles and SiC as hard particles. The film 3 contained 2 to 15% by volume of each of C and SiC.

A composite plating solution 29 (see FIG. 3) contained 0.415 g/cm$^3$ of nickel sulfate ($NiSO_4$), 0.05 to 0.08 g/cm$^3$ of copper sulfate ($CuSO_4$), 0.1 to 0.16 g/cm$^3$ of trisodium citrate, 0.035 g/cm$^3$ of boric acid and $5\times10^{-6}$ to $3\times10^{-5}$ mol/cm$^3$ of sodium saccharate, and had a pH of 5.0. It also contained C and SiC particles suspended in the amounts of $4.2\times10^{-4}$ to $4.2\times10$ mol/cm$^3$ and 0.001 to 0.005 mmol/cm$^3$, respectively, and had a temperature of 60° C. Each cylindrical electrode 15 (see FIG. 5) had 169 through holes 18 made in its cylindrical wall 17 and each having a diameter of 2.0 mm.

The composite plating conditions as employed for Experiment 1 were employed again, and an electric current was first supplied to the cylindrical electrode 15 and a cylinder block 1 at a current density of 14 A/dm$^2$ for one minute and 10 seconds, while the cylindrical electrode was rotated at a speed of 5 rpm and the plating solution 29 was circulated at a rate of $30\times10^3$ cm$^3$/min. Then, an electric current was supplied to the cylindrical electrode 15 and the cylinder block 1 at a current density of 20 to 40 A/dm$^2$ for six minutes and 51 seconds to 13 minutes and 40 seconds, while the cylindrical electrode was rotated at a speed of 5 rpm and the plating solution 29 was circulated at a rate of 30 l/min. As a result, there was formed a film having a thickness of 56.5 microns. Its nickel and copper alloy matrix contained 30 atm. % of copper. Its copper content of 30 atm. % falls within the range of 10 to 50 atm. % as explained with reference to the graphs of FIGS. 15A to 16B. It, therefore, follows that the film is satisfactorily high in corrosion and wear resistances. It also contained 2 to 15% by volume of C and 2 to 15% by volume of SiC. They ensure the satisfactorily high lubricating property of the film. Its lubricating property will be explained in detail with reference to FIG. 20 later.

Figure 17:
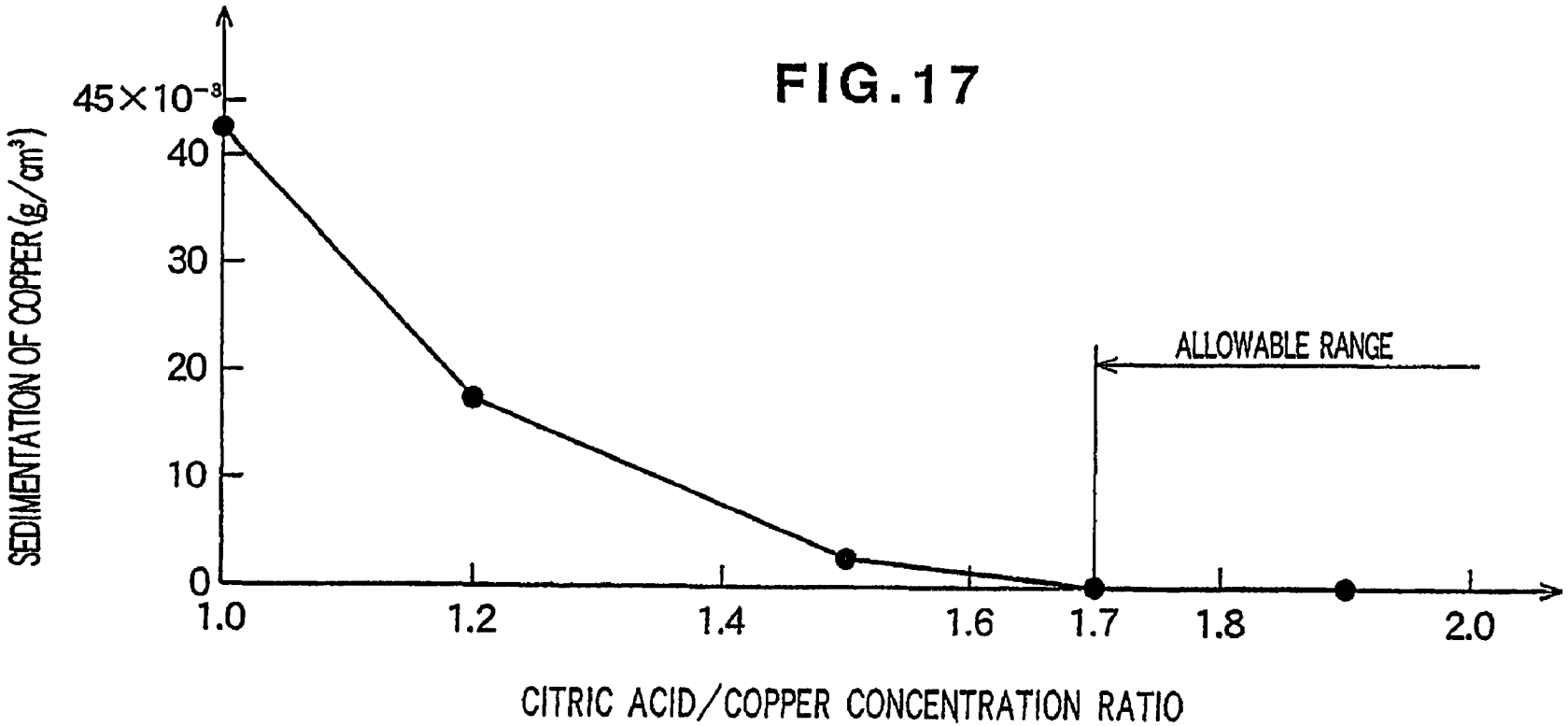
FIG. 17 is a graph showing the sedimentation of copper in relation to the ratio in concentration of citric acid to copper in a composite nickel and copper alloy plating solution according to this invention.

Explanation will now be made as to the relation between citric acid and copper in a composite nickel and copper alloy plating solution. FIG. 17 is a graph showing the sedimentation of copper in a composite nickel and copper alloy plating solution according to this invention in relation to the ratio in concentration of citric acid in the solution to copper (hereinafter referred to as "citric acid/copper concentration ratio"), which ratio is shown along the x-axis, while the sedimentation of copper is shown along the y-axis.

Copper makes a sedimentation of about $42\times10^{-3}$ g/cm$^3$ at a citric acid/copper concentration ratio of 1.0, a sedimentation of about $18\times10^{-3}$ g/cm$^3$ when the ratio is 1.2, and a sedimentation of about $2\times10^{-3}$ g/cm$^3$ when the ratio is 1.5. The sedimentation of copper means a reduction of copper in the solution (or a reduction in the amount of copper dissolved in the solution). Accordingly, no satisfactory deposition of copper can be realized by plating. Copper, however, does not make any sedimentation if the ratio exceeds 1.7. Citric acid serves as a complex-forming agent and enables the satisfactory dissolution of copper in the plating solution and thereby its satisfactory deposition by plating. Thus, it is obvious that a citric acid/copper concentration ratio of at least 1.7 ensures the formation of a satisfactory deposit of copper having a high corrosion resistance and thereby a plating film of high corrosion resistance.

Figure 18:
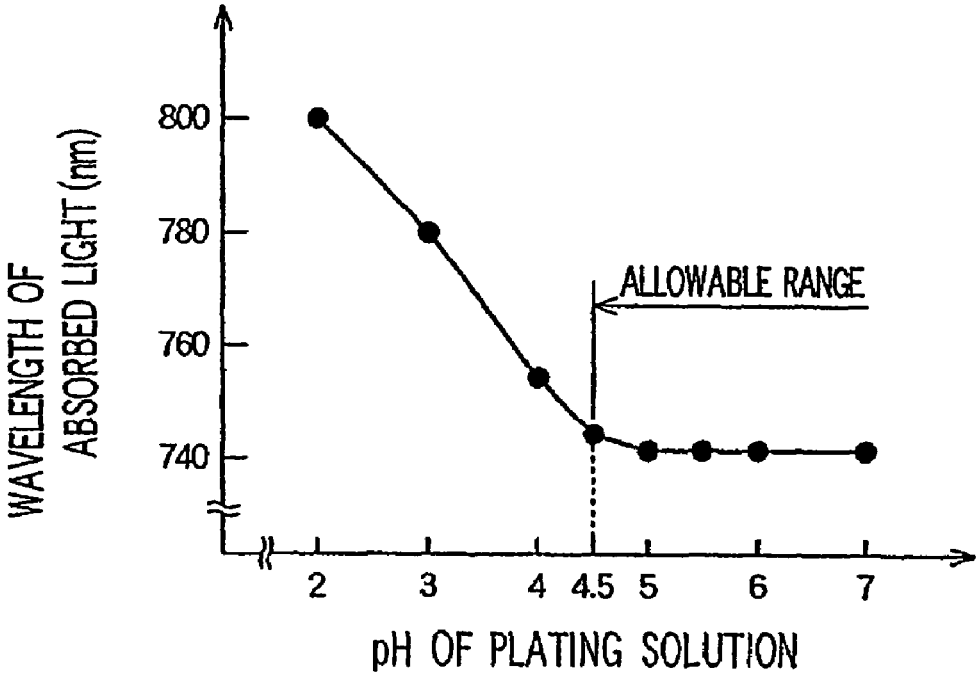
FIG. 18 is a graph showing the wavelength of light absorbed by a composite nickel and copper alloy plating solution in relation to its pH.

FIG. 18 is a graph showing the wavelength of absorbed light in a composite nickel and copper alloy plating solution along the y-axis in relation to its pH shown along the x-axis. The wavelength of absorbed light is that of light absorbed by the metal ions in the solution. It is, therefore, measured to determine the concentration of metal ions in the solution.

According to FIG. 18, the wavelength of light absorbed by a plating solution varies from 800 nm when its pH is 2, to 780 nm when its pH is 3, to 750 nm when its pH is 4, and to 740 nm when its pH is 4.5. Such a variation means that the metal ions in the solution vary in concentration and make it unstable. Thus, no solution having a pH below 4.5 is satisfactory for any satisfactory deposition of a metal matrix for a plating film. The wavelength, however, remains steady at about 740 nm when the solution has a pH of 4.5 or above. The steady wavelength means the constant concentration of metal ions and the stability of the solution. Thus, a solution having a pH of 4.5 or above ensures the satisfactory deposition of a metal matrix for a plating film.

Figure 19:
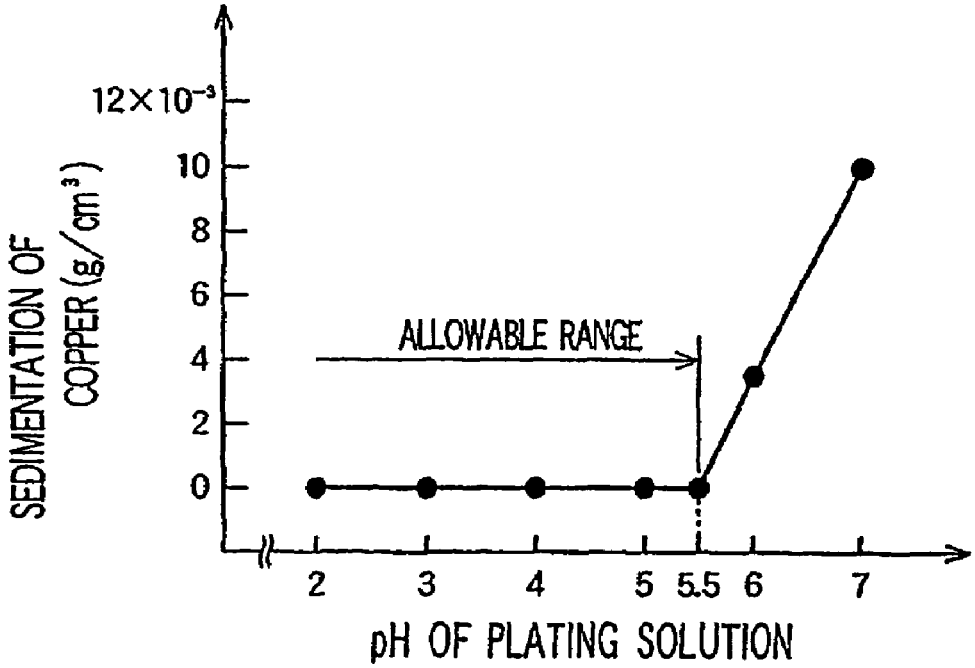
FIG. 19 is a graph showing the sedimentation of copper in a composite nickel and copper alloy plating solution in relation to its pH.

FIG. 19 is a graph showing the sedimentation of copper in a composite nickel and copper alloy plating solution along the y axis in relation to its Ph shown along the x-axis. There is no sedimentation of copper when the solution has a Ph of 5.5 or below, since copper is thoroughly dissolved in the solution. Thus, a solution having a pH of 5.5. or below ensures the satisfactory deposition of copper and thereby the formation of a plating film of high corrosion resistance owing to the high corrosion resistance of copper. The sedimentation of copper occurs in a solution having a pH above 5.5, since copper is not thoroughly dissolved in the solution. Thus, no solution having a pH above 5.5 is satisfactory for any satisfactory deposition of copper for a plating film of high corrosion resistance.

Thus, it is obvious from FIGS. 18 and 19 that a plating solution having a pH of 4.5 to 5.5 forms a good plating film of high corrosion resistance on the inner wall surface of a cylinder.

Description will now be made of Experiment 3 with reference to Table 3. It is, however, to be understood that the following is not intended for limiting the scope of this invention.

TABLE 3

| | | | |
|---|---|---|---|
| Plating solution | Composite plating film | | Ni—Cu + BN + SiC |
| | Nickel sulfate | | 0.2~0.4 g/cm$^3$ |
| | Copper sulfate | | 0.02~0.06 g/cm$^3$ |
| | Trisodium citrate | | 0.03~0.1 g/cm$^3$ |
| | Surface active agent | | 0.005~0.1 mol/cm$^3$ |
| | Sodium saccharate | | $5 \times 10^{-5}$~$3 \times 10^{-5}$ mol/cm$^3$ |
| | Boron nitride (h-BN) in suspension | | $4 \times 10^{-4}$~$4 \times 10^{-3}$ mol/cm$^3$ |
| | Silicon carbide (SiC) | | 0.001~0.005 mol/cm$^3$ |
| | pH | | 4~6 |
| | Temperature | | 50~80° C. |
| Cylindrical electrode | Hole diameter | | 2.0 mm |
| | Number of holes | | 169 |
| | Inside diameter | | 25.0 mm |
| | Rotating speed | | 5 rpm |
| | Plating method | | High-speed jet plating |
| Plating conditions | Initial | Solution flow rate | $30 \times 10^3$ cm$^3$/min. |
| | | Current density | 14 A/dm$^2$ |
| | | Time | 1 min. 10 sec. |
| | Regular | Solution flow rate | $30 \times 10^3$ cm$^3$/min. |
| | | Current density | 20~40 A/dm$^2$ |
| | | Time | 6 min. 51 sec.–13 min. 40 sec. |
| Results | Film thickness | | 56.5 μm |
| | per content | | 30 atm % |
| | Boron nitride (h-BN) | | 1.3 wt % (5.0 vol %) |
| | Silicon carbide (SiC) | | 1.9 wt % (5.0 vol %) |

Experiment 3

Description is made of an example in which a composite plating film 3 was formed by a nickel and copper alloy matrix containing 30 atm. % of copper, h-BN as self-lubricating particles and SiC as hard particles. The film 3 contained 5.0% by volume (1.3% by weight) of h-BN and 5.0% by volume (1.9% by weight) of SiC.

A composite plating solution 29 (see FIG. 3) contained 0.2 to 0.4 g/cm$^3$ of nickel sulfate ($NiSO_4$), 0.02 to 0.06 g/cm$^3$ of copper sulfate ($CuSO_4$), 0.03 to 0.1 g/cm$^3$ of trisodium citrate, 0.005 to 0.1 mol/cm$^3$ of a surface active agent and $5\times10^{-6}$ to $3\times10^{-5}$ mol/cm$^3$ of a hardness raising agent, and had a pH of 4 to 6. It also contained h-BN and SiC particles suspended in the amounts of $4\times10^{-4}$ to $4\times10^{-3}$ mol/cm$^3$ and 0.001 to 0.005 mol/cm$^3$, respectively, and had a temperature of 50° C. to 80° C. Although it is preferable according to the graphs of FIGS. 18 and 19 that the solution 29 have a pH of 4.5 to 5.5, its pH of 4 to 6 is selected by taking an allowable range into account. Each cylindrical electrode 15 (see FIG. 5) had 169 through holes 18 made in its cylindrical wall 17 and each having a diameter of 2.0 mm.

Referring to the composite plating conditions, an electric current was first supplied to the cylindrical electrode 15 and a cylinder block 1 at a current density of 14 A/dm$^2$ for one minute and 10 seconds, while the cylindrical electrode was rotated at a speed of 5 rpm and the plating solution 29 was circulated at a rate of $30\times10^{-3}$ cm$^3$/min. Then, an electric current was supplied to the cylindrical electrode 15 and the cylinder block 1 at a current density of 20 to 40 A/dm$^2$ for six minutes and 51 seconds to 13 minutes and 40 seconds, while the cylindrical electrode was rotated at a speed of 5 rpm and the solution 29 was circulated at a rate of $30\times10^3$ cm$^3$/min.

As a result, there was formed a film having a thickness of 56.5 microns. Its nickel and copper alloy matrix contained 30 atm. % of copper, 5.0% by volume (1.3% by weight) of h-BN and 5.0% by volume (1.9% by weight) of SiC. Its copper content of 30 atm. % falls within the range of 10 to 50 atm. % as explained with reference to the graphs of FIGS. 15A to 16B. It, therefore, follows that the film is satisfactorily high in corrosion and wear resistances.

Figure 20:
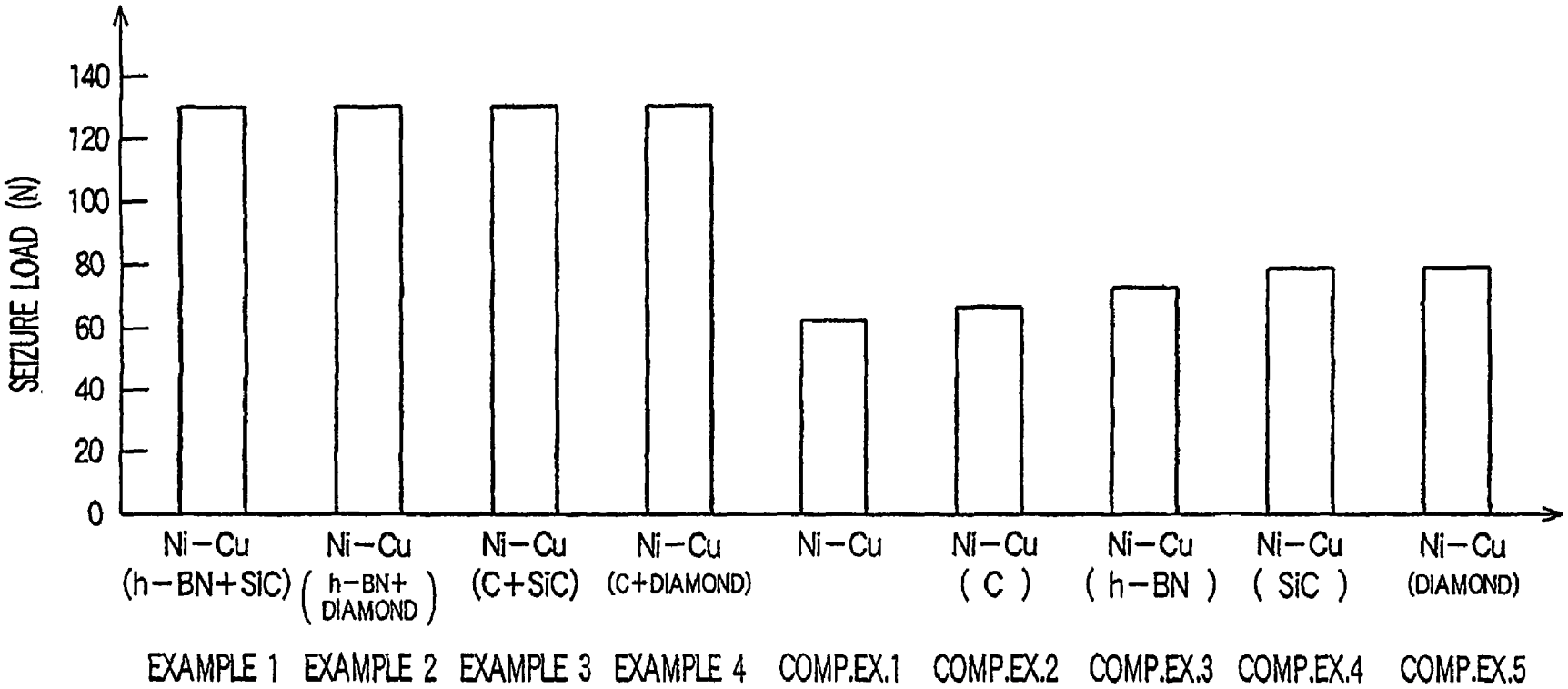
FIG. 20 is a graph explaining the lubricating property of a composite nickel and copper alloy plating film.

FIG. 20 is a graph showing the lubricating property of several examples of composite nickel and copper alloy plating films according to the second embodiment of this invention by a seizure load (N) which is shown along the y-axis. The seizure load is determined by holding a piston ring against a film at a predetermined pressure P and reciprocating the piston ring along the film at a specific speed for a specific length of time. If any seizure has occurred, the pressure P is called the seizure load.

Comparative Example 1 is a Ni—Cu alloy plating film containing 30 atm. % of copper and not containing any self-lubricating or hard particles. It has a seizure load which is as low as 65 N because of the absence of self-lubricating and hard particles.

Comparative Example 2 is a composite Ni—Cu alloy plating film containing 30 atm. % of copper and 2 to 15% by volume of C as self-lubricating particles. It has a seizure load which is as low as 70 N, since it does not contain any hard particles.

Comparative Example 3 is a composite Ni—Cu alloy plating film containing 30 atm. % of copper and 2 to 15% by volume of h-BN as self-lubricating particles. It has a seizure load which is as low as 75 N, since it does not contain any hard particles.

Comparative Example 4 is a composite Ni—Cu alloy plating film containing 30 atm. % of copper and 2 to 15% by volume of SiC as hard particles. It has a seizure load which is as low as 80. N, since it does not contain any self-lubricating particles.

Comparative Example 5 is a composite Ni—Cu alloy plating film containing 30 atm. % of copper and 2 to 15% by volume of diamond as hard particles. It has a seizure load which is as low as 80 N, since it does not contain any self-lubricating particles.

Example 1 of this invention is a composite Ni—Cu alloy plating film containing 30 atm. % of copper, 2 to 15% by volume of h-BN as self-lubricating particles and 2 to 15% by volume of SiC as hard particles. It has a seizure load which is as high as 130 N, since it contains both self-lubricating and hard particles.

Example 2 is a composite Ni—Cu alloy plating film containing 30 atm. % of copper, 2 to 15% by volume of h-BN as self-lubricating particles and 2 to 15% by volume of diamond as hard particles. It has a seizure load which is as high as 130 N, since it contains both self-lubricating and hard particles.

Example 3 is a composite Ni—Cu alloy plating film containing 30 atm. % of copper, 2 to 15% by volume of C as self-lubricating particles and 2 to 15% by volume of SiC as hard particles. It has a seizure load which is as high as 130 N, since it contains both self-lubricating and hard particles.

Example 4 is a composite Ni—Cu alloy plating film containing 30 atm. % of copper, 2 to 15% by volume of C as self-lubricating particles and 2 to 15% by volume of diamond as hard particles. It has a seizure load which is as high as 130 N, since it contains both self-lubricating and hard particles.

Thus, it is obvious that a Ni—Cu alloy plating film not containing either self-lubricating or hard particles is unsatisfactory in lubricating property as indicated by its seizure load of as low as 65 N. It is also obvious that a Ni—Cu alloy plating film not containing both self-lubricating and bard particles is unsatisfactory in lubricating property as indicated by its seizure load of as low as 70 to 80 N. On the other hand, a film containing both self-lubricating and hard particles is satisfactorily high in lubricating property as indicated by its seizure load of as high as 130 N.

Although every plating film embodying this invention has been described as being formed by using four cylindrical electrodes 15 in a cylinder block 1 for a four-cylinder engine, this invention is also applicable to, for example, a cylinder block for a six-cylinder engine if an appropriate number of cylindrical electrodes 15 is employed. Although every composite plating film 3 embodying this invention has been described as being formed on the inner wall surface 2*a* of a cylinder in a cylinder block 1, it can alternatively be formed on any other work. Although the surface active agent has been described as being cationic, it is also possible to use an anionic, nonionic or amphoteric (anionic-nonionic) surface active agent.

INDUSTRIAL APPLICABILITY

According to this invention, a plating film is formed on a base surface by an alternate array of nickel and copper alloys layers and its surface is roughened to expose the nickel and copper alloys substantially uniformly therein, as described above. Nickel is high in wear resistance, and copper in corrosion resistance. The film has its lubricating property and wear resistance improved to a further extent by containing self-lubricating and hard particles, and is useful as a coating on, for example, the inner wall surface of a cylinder for an internal combustion engine.

The invention claimed is:

1. A composite plating film covering a base surface and consisting essentially of a composite nickel and copper alloy film composed of nickel and copper, wherein the alloy film comprises an alternate array of nickel and copper alloy layers, each nickel alloy layer containing less than 50% of copper with nickel and each copper layer containing less than 50% of nickel with copper, the film having a surface roughened to a roughness of one to three microns as expressed by maximum height (Rmax) to have the nickel and copper alloys exposed substantially uniformly therein.

2. The film according to claim 1, wherein the alloy film further contains self-lubricating and hard particles.

3. The film according to claim 2, wherein the self-lubricating particles are of at least one of graphite, hexagonal boron nitride and molybdenum disulfide.

4. The film according to claim 2, wherein the hard particles are of at least one of silicon carbide, silicon nitride, alumina, cubic boron nitride and diamond.

5. The film according to claim 1, wherein the alloy film is formed on the inner wall surface of a cylinder in an internal combustion engine.

6. A composite plating film covering a base surface and consisting essentially of a composite nickel and copper alloy film composed of nickel and copper, wherein the alloy film contains 10 to 50 atm. % of copper, nickel, self-lubricating particles and hard particles.

7. The film according to claim 6, wherein the self-lubricating particles are of at least one of graphite, hexagonal boron nitride and molybdenum disulfide.

8. The film according to claim 6, wherein the hard particles are of at least one of silicon carbide, silicon nitride, alumina, cubic boron nitride and diamond.

9. The film according to claim 6, wherein the alloy film contains 2 to 15% by volume of each of the self-lubricating and hard particles.

10. The film according to claim 6, wherein the alloy film is formed on the inner wall surface of a cylinder in an internal combustion engine.

11. A plating film on an inner wall surface of a cylinder in an infernal combustion engine, comprising:

a composite nickel and copper alloy film, wherein the alloy film contains 10 to 50 atm. % of copper, nickel, self-lubricating particles and hard particles.

12. The film according to claim 11, wherein the self-lubricating particles are of at least one of graphite, hexagonal boron nitride and molybdenum disulfide.

13. The film according to claim 11, wherein the hard particles are of at least one of silicon carbide, silicon nitride, alumina, cubic boron nitride and diamond.

14. The film according to claim 11, wherein the alloy film contains 2 to 15% by volume of each of the self-lubricating and hard particles.

15. A composite plating film covering a base surface and comprising a composite nickel and copper alloy film that includes alternating nickel alloy layers and copper alloy layers, wherein each nickel alloy layer includes copper, and each copper alloy layer includes nickel, the film having a surface roughened to a roughness of one to three microns as expressed by maximum height (Rmax) to have the nickel and copper alloys exposed substantially uniformly therein.

16. The film according to claim 15, wherein the alloy film further contains self lubricating and hard particles.

17. The film according to claim 16, wherein the self-lubricating particles are of at least one of graphite, hexagonal boron nitride and molybdenum disulfide.

18. The film according to claim 16, wherein the hard particles are of at least one of silicon carbide, silicon nitride, alumina, cubic boron nitride and diamond.

19. The film according to claim 15, wherein the alloy film is formed on the inner wall surface of a cylinder in an internal combustion engine.

* * * * *